US010625294B2

(12) United States Patent
Burns

(10) Patent No.: US 10,625,294 B2
(45) **Date of Patent: *Apr. 21, 2020**

(54) CONTAINER AND SUBSTANCE DISPENSING SYSTEM

(71) Applicant: Rooftop Research, LLC., New Wilmington, PA (US)

(72) Inventor: Robert S. Burns, New Wilmington, PA (US)

(73) Assignee: Rooftop Research, LLC, New Wilmington, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/425,380

(22) Filed: Feb. 6, 2017

(65) Prior Publication Data

US 2017/0144188 A1 May 25, 2017

Related U.S. Application Data

(63) Continuation of application No. 13/834,921, filed on Mar. 15, 2013, now Pat. No. 9,597,706.

(51) Int. Cl.
*B05C 17/005* (2006.01)

(52) U.S. Cl.
CPC .. *B05C 17/00583* (2013.01); *B05C 17/00503* (2013.01); *B05C 17/00553* (2013.01); *B05C 17/00576* (2013.01)

(58) Field of Classification Search
CPC ..... B05C 17/00573; B05C 17/00583; B65D 83/0072; B65D 83/0005; B67D 1/0462
See application file for complete search history.

(56) References Cited

U.S. PATENT DOCUMENTS 2,242,876 A * 5/1941 Winters ..... A61M 11/00 222/322
2,477,875 A * 8/1949 Hutchason ..... B65D 83/0027 222/95
2,684,791 A * 7/1954 Sebell ..... B65D 83/0005 222/386
2,695,735 A * 11/1954 Doornik ..... B65D 83/0005 222/386
2,752,075 A 6/1956 Hill
3,066,836 A * 12/1962 Trumbull ..... B05C 17/00576 222/327
3,143,429 A * 8/1964 Swanson ..... B65D 1/0292 426/117
3,215,320 A * 11/1965 Heisler ..... B05C 17/01 222/391

(Continued)

*Primary Examiner* — Paul R Durand
*Assistant Examiner* — Randall A Gruby
(74) *Attorney, Agent, or Firm* — Dority & Manning, P.A.

(57) ABSTRACT

A confinement structure and an actuation member that provides a system that allows for controllable deformation of a variety of containers are disclosed. In one embodiment, the system of the present disclosure provides for controllable deformation of a container such that a portion of the container acts as a wiping means to empty a substance from the container. A container that includes an indentation formed on a first end of the container and a container opening located at a second end of the container is also disclosed. In one embodiment, with the container deformed to a final position, the indentation fits inside the container opening to completely expel a substance from the container.

15 Claims, 31 Drawing Sheets

(56) References Cited

U.S. PATENT DOCUMENTS 3,323,682 A 6/1967 Creighton, Jr. et al.
3,669,323 A * 6/1972 Harker ..... B65D 35/14 222/490
3,767,078 A 10/1973 Gortz et al.
3,791,557 A 2/1974 Venus, Jr.
3,827,602 A 8/1974 Nicholls
3,884,396 A 5/1975 Gordon et al.
4,030,643 A 6/1977 Van Manen
4,236,516 A 12/1980 Nilson
4,269,330 A * 5/1981 Johnson ..... B65D 83/0005 222/386
4,356,935 A * 11/1982 Kamin ..... A47G 19/183 206/384
4,749,337 A 6/1988 Dickinson et al.
4,753,638 A 6/1988 Peters
4,972,969 A 11/1990 Randklev
5,069,364 A 12/1991 McGill
5,150,820 A 9/1992 McGill
5,312,028 A 5/1994 Hume
5,333,761 A 8/1994 Davis et al.
5,346,476 A 9/1994 Elson
5,361,941 A 11/1994 Parekh et al.
5,375,740 A * 12/1994 Umetsu ..... A23G 3/2023 222/327
5,401,254 A 3/1995 Bunce
5,407,093 A 4/1995 McGill
5,411,180 A 5/1995 Dumelle
5,416,303 A 5/1995 Grooms et al.
5,501,368 A 3/1996 Brandhorst et al.
5,547,107 A 8/1996 Boiardi
5,632,415 A 5/1997 McGill
5,667,102 A 9/1997 Keller
5,699,935 A 12/1997 Stahley
5,755,361 A 5/1998 Restive et al.
5,799,827 A 9/1998 D'Andrade
5,893,485 A 4/1999 McGill
5,913,342 A 6/1999 McGill
5,918,767 A * 7/1999 McGill ..... A23G 3/28 222/105
5,974,971 A * 11/1999 Moller ..... B41F 31/02 101/366
5,984,199 A 11/1999 Restive
6,085,652 A 7/2000 Deschner et al.
6,158,621 A * 12/2000 Keller ..... B05C 17/00583 222/105
6,206,242 B1 3/2001 Amberg et al.
6,257,448 B1 7/2001 D'Andrade et al.
6,264,066 B1 7/2001 Vincent et al.
6,325,244 B2 12/2001 Vincent et al.
6,328,715 B1 12/2001 Dragan et al.
6,412,707 B1 7/2002 Wirz
6,419,351 B1 * 7/2002 Lawson ..... B41F 31/08 347/86
6,431,411 B1 8/2002 Wenner
6,443,333 B1 9/2002 Vanmoor
6,453,803 B1 9/2002 Sodeyama et al.
6,578,738 B1 6/2003 Keller
6,595,392 B2 7/2003 Barnett
6,662,969 B2 12/2003 Peeler et al.
6,715,648 B2 4/2004 Kim
6,820,765 B2 11/2004 Pahl
6,913,168 B2 * 7/2005 Lawson ..... B41J 2/17523 222/153.13
7,017,783 B1 3/2006 Hunter et al.
7,033,004 B2 4/2006 Ghisalberti et al.
7,056,556 B2 6/2006 Burns
7,165,699 B2 1/2007 McGill
7,753,239 B2 7/2010 Chang
8,235,257 B2 8/2012 Avairis
8,342,372 B2 1/2013 Choiniere et al.
8,875,913 B2 11/2014 Diaz
8,925,764 B2 1/2015 Hiemer
8,955,437 B2 2/2015 Izume
8,998,020 B2 4/2015 Sato et al.
8,998,040 B2 4/2015 Burns
9,579,686 B2 * 2/2017 Springhorn ..... B05C 17/00586
9,597,706 B2 * 3/2017 Burns ..... B05C 17/00583
9,815,680 B2 * 11/2017 Tomesch ..... B67D 3/007
2002/0088827 A1 7/2002 Colucci
2002/0119221 A1 8/2002 Matsukura et al.
2002/0121527 A1 9/2002 Good
2003/0089736 A1 5/2003 Ichikawa et al.
2003/0102333 A1 6/2003 Wright
2004/0011815 A1 1/2004 Martin
2005/0279776 A1 12/2005 Decottignies
2006/0054641 A1 3/2006 Evers
2006/0255066 A1 11/2006 Kannar et al.
2008/0000928 A1 1/2008 Choiniere et al.
2009/0052970 A1 2/2009 Jung
2010/0252583 A1 * 10/2010 Maas ..... B65D 25/14 222/386.5
2011/0259912 A1 10/2011 Choiniere et al.
2011/0259919 A1 10/2011 Choiniere et al.
2012/0012054 A1 1/2012 Galvin et al.
2012/0042826 A1 2/2012 Galvin et al.
2012/0074167 A1 3/2012 Galvin et al.
2012/0103465 A1 5/2012 Paluncic et al.
2012/0181301 A1 7/2012 Choiniere et al.
2013/0008376 A1 1/2013 Snowwhite et al.
2013/0026182 A1 1/2013 Habibi-Naini
2013/0056491 A1 * 3/2013 Suzuki ..... B05B 9/047 222/95
2014/0224837 A1 4/2014 Eisenbacher
2014/0367419 A1 12/2014 Harris et al.
2015/0053716 A1 2/2015 Meinzinger et al.
2015/0060485 A1 3/2015 Gamburg et al.
2015/0114986 A1 4/2015 Ngu et al.
2015/0237884 A1 8/2015 McGill et al.
2017/0327299 A1 * 11/2017 Buck ..... B65D 83/0072
2018/0009595 A1 * 1/2018 Witcher ..... B65D 83/0066

* cited by examiner 62
74
60,72
16,70
78
64
66
20
26
40
12
76
44
46
24
50
14
10
52
42
54
28
22
30
32

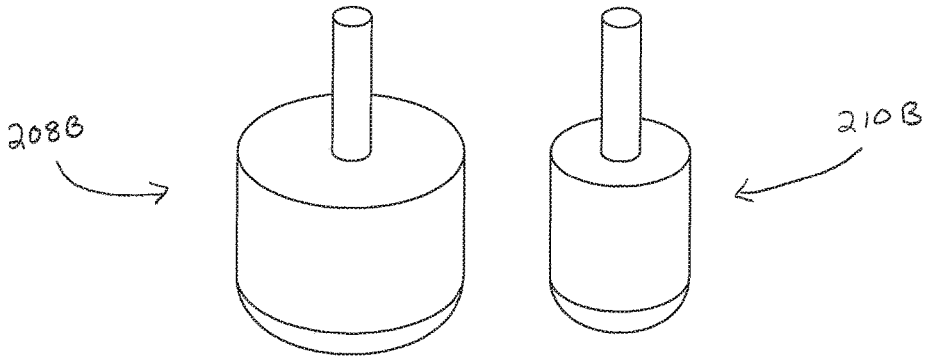
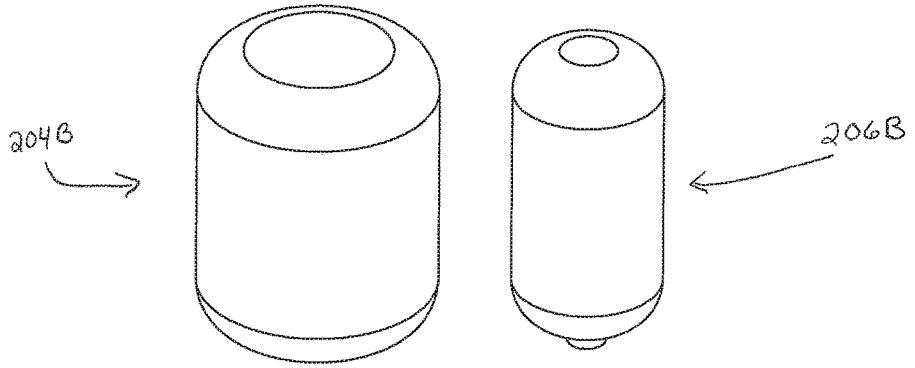
FIG. 20B
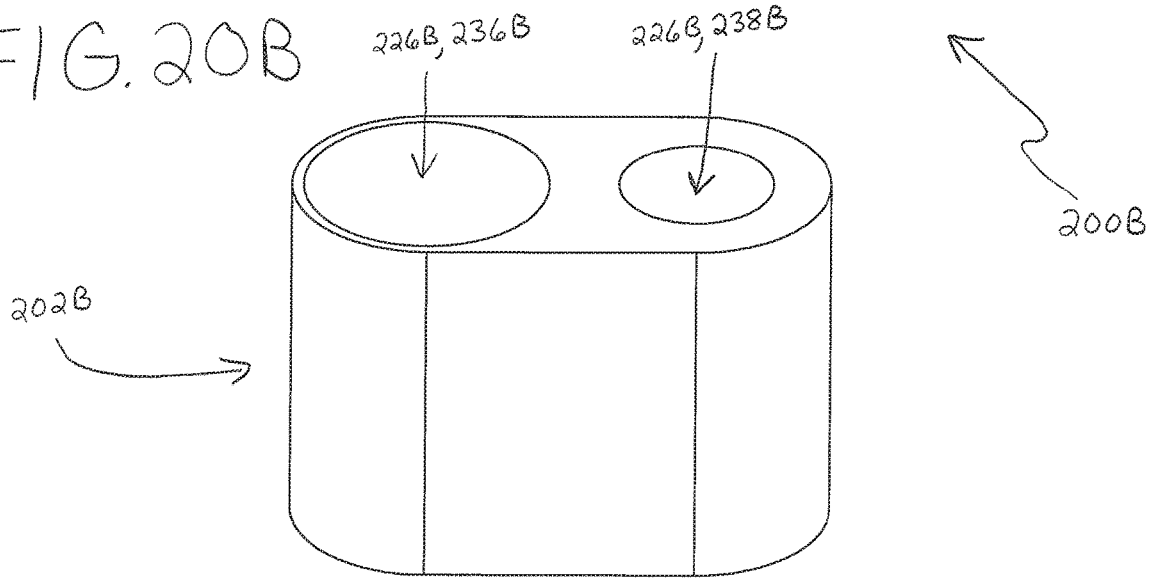

CONTAINER AND SUBSTANCE DISPENSING SYSTEM

CROSS-REFERENCE TO RELATED APPLICATION

The present application claims priority to U.S. application Ser. No. 13/834,921 entitled "Container and Substance Dispensing System", filed Mar. 15, 2013, the entire disclosure of which is hereby expressly incorporated by reference herein.

BACKGROUND OF THE INVENTION

1. Field of the Disclosure

The present disclosure relates generally to a substance dispensing system. More particularly, the present disclosure relates to a container for holding a substance and a dispensing system for expelling the substance from the container.

2. Description of the Related Art

Containers are used to hold liquids until it is desired to dispense such liquids. A force is applied to the outside of the container to deform the container and dispense the liquid. However, such deformation of a container to dispense a liquid is random and causes undesired consequences. For example, in a sausage caulking gun or similar operation, a seal between the dispensing components is difficult to maintain and the flexible wall of the container is able to slip between a plate and an inside wall of a vessel the container is within. This condition is often referred to as "blow by" and causes a significant portion of the liquid to be stuck within the blown by portion of the container. This significant portion of the liquid is then unable to be dispensed.

Furthermore, when a container slips by a plate in this manner, the container often tears, or may even burst, causing the liquid to undesirably escape. Leaks of the liquid from the container in this way are not acceptable due to the loss of the liquid, the messy nature of the leak, the damage the liquid may cause to the system, and the performance problems the liquid may cause to the system.

SUMMARY OF THE INVENTION

The present disclosure provides a confinement structure and an actuation member that provides a system that allows for controllable deformation of a variety of containers. A system of the present disclosure provides for controllable deformation of a container such that a portion of the container acts as a wiping means to empty a substance from the container.

The present disclosure also provides a container that includes an indentation formed on a first end of the container and a container opening located at a second end of the container. In one embodiment, with the container deformed to a final position, the indentation fits inside the container opening to completely expel a substance from the container.

In accordance with an embodiment of the present disclosure, a combination includes a confinement structure having a proximal end, a distal end, and a sidewall extending therebetween and defining an interior, the distal end of the confinement structure defining an interior profile. The combination includes a container having a first end, a second end, and a deformable wall extending therebetween and defining a container interior adapted to hold a substance, the container sized to be positionable within the interior of the confinement structure. The combination further includes an actuation member movably positionable within the confinement structure, the actuation member having an exterior wall defining an exterior profile, the exterior profile of the actuation member shaped to substantially correspond to the interior profile of the confinement structure, wherein, with the container positioned within the confinement structure, the actuation member is movable between a first position in which the actuation member is adjacent the proximal end of the confinement structure and a second position in which the actuation member is adjacent the distal end of the confinement structure.

In one configuration, the actuation member has an actuation member diameter and the first end of the container has a container diameter, the actuation member diameter being less than the container diameter. In another configuration, the proximal end of the confinement structure has an interior confinement structure diameter, the container diameter being less than the interior confinement structure diameter. In yet another configuration, as the actuation member moves from the first position towards the second position, the actuation member deforms the container thereby expelling the substance from the container. In one configuration, the actuation member includes a plunger, the plunger having a proximal wall, a distal wall, and a plunger sidewall extending therebetween, and as the plunger moves from the first position towards the second position, the plunger deforms the container such that, a portion of the first end of the container extends past the distal wall of the plunger towards the proximal wall of the plunger. In another configuration, the portion of the first end of the container that extends past the distal wall of the plunger towards the proximal wall of the plunger is disposed between the sidewall of the confinement structure and the plunger sidewall. In yet another configuration, with the portion of the first end of the container extending past the distal wall of the plunger towards the proximal wall of the plunger, the first end of the container includes a concave shape. In one configuration, the concave shape of the first end of the container acts as a wiping means to empty the substance from the container. In another configuration, with the plunger in the second position, the substance is completely expelled from the container. In yet another configuration, the exterior profile is defined by the distal wall of the plunger. In one configuration, the proximal end of the confinement structure includes an open end and the distal end of the confinement structure includes an exit aperture, wherein as the plunger moves from the first position towards the second position, the plunger deforms the container thereby expelling the substance from the container and out the exit aperture of the confinement structure. In another configuration, the container has a tear resistance sufficient to withstand tearing when the plunger moves from the first position towards the second position. In yet another configuration, the second end of the container defines a container profile, the container profile of the container shaped to substantially correspond to the interior profile of the confinement structure. In one configuration, the combination further includes the interior of the confinement structure having a first cavity and a second cavity, the first cavity defining a first cavity profile and the second cavity defining a second cavity profile, the container sized to be positionable within the first cavity of the confinement structure, the exterior profile of the actuation member shaped to substantially correspond to the first cavity profile of the confinement structure; a second container having a second container first end, a second container second end, and a second container deformable wall extending therebetween and defining a second container interior adapted to hold a second substance, the second container sized to be positionable within the second cavity of the confinement structure; and a second actuation member movably positionable within the confinement structure, the second actuation member having a second actuation member exterior wall defining a second actuation member exterior profile, the second actuation member exterior profile shaped to substantially correspond to the second cavity profile of the confinement structure, wherein, with the container and the second container positioned within the confinement structure, the actuation member and the second actuation member are movable between the first position and the second position. In another configuration, the confinement structure is a single component. In yet another configuration, the confinement structure is two components. In one configuration, the confinement structure is four components. In another configuration, the substance is an adhesive. In yet another configuration, the substance is a coating. In one configuration, the substance is a caulking.

In accordance with another embodiment of the present disclosure, a method of deforming a container, the method including: selecting a container, comprising: a first end; a second end; and a deformable wall extending between the first end and the second end, the deformable wall defining a container interior adapted to hold a substance; placing an actuation member relative to the container such that the actuation member is movable between a first position in which the actuation member is adjacent the first end of the container and a second position in which the actuation member is adjacent the second end of the container; and moving the actuation member from the first position towards the second position to controllably deform the container such that, a portion of the first end of the container extends past the actuation member and acts as a wiping means to empty the substance from the container.

In one configuration, with the actuation member in the second position, the substance is completely expelled from the container.

In accordance with another embodiment of the present disclosure, a container includes a first end, a second end, and a deformable wall extending between the first end and the second end, the deformable wall defining a container interior adapted to hold a substance. The container further includes an indentation formed in the first end of the container and a container opening located at the second end of the container, the container opening in fluid communication with the container interior, wherein the container is deformable to a final position in which the indentation of the container fits inside the container opening.

In one configuration, with the indentation of the container inside the container opening, the substance is completely expelled from the container. In another configuration, the container opening includes a neck portion extending from the second end of the container. In yet another configuration, in the final position, the indentation of the container fits inside the neck portion of the container to completely expel the substance from the container. In one configuration, the container is deformable from an undeformed position to the final position.

In accordance with another embodiment of the present disclosure, a combination includes a confinement structure having a proximal end, a distal end, and a sidewall extending therebetween and defining an interior, the distal end of the confinement structure defining an interior profile; and an actuation member movably positionable within the confinement structure, the actuation member having an exterior wall defining an exterior profile, the exterior profile of the actuation member shaped to substantially correspond to the interior profile of the confinement structure.

In one configuration, the combination further includes a container having a first end, a second end, and a deformable wall extending therebetween and defining a container interior adapted to hold a substance, the container sized to be positionable within the interior of the confinement structure, wherein, with the container positioned within the confinement structure, the actuation member is movable between a first position in which the actuation member is adjacent the proximal end of the confinement structure and a second position in which the actuation member is adjacent the distal end of the confinement structure.

BRIEF DESCRIPTION OF THE DRAWINGS

The above-mentioned and other features and advantages of this disclosure, and the manner of attaining them, will become more apparent and the disclosure itself will be better understood by reference to the following descriptions of embodiments of the disclosure taken in conjunction with the accompanying drawings, wherein:

FIG. 20B is another exploded, perspective view of a substance dispensing system in accordance with another embodiment of the present invention.

Corresponding reference characters indicate corresponding parts throughout the several views. The exemplifications set out herein illustrate exemplary embodiments of the disclosure, and such exemplifications are not to be construed as limiting the scope of the disclosure in any manner.

DETAILED DESCRIPTION

Figure 1:
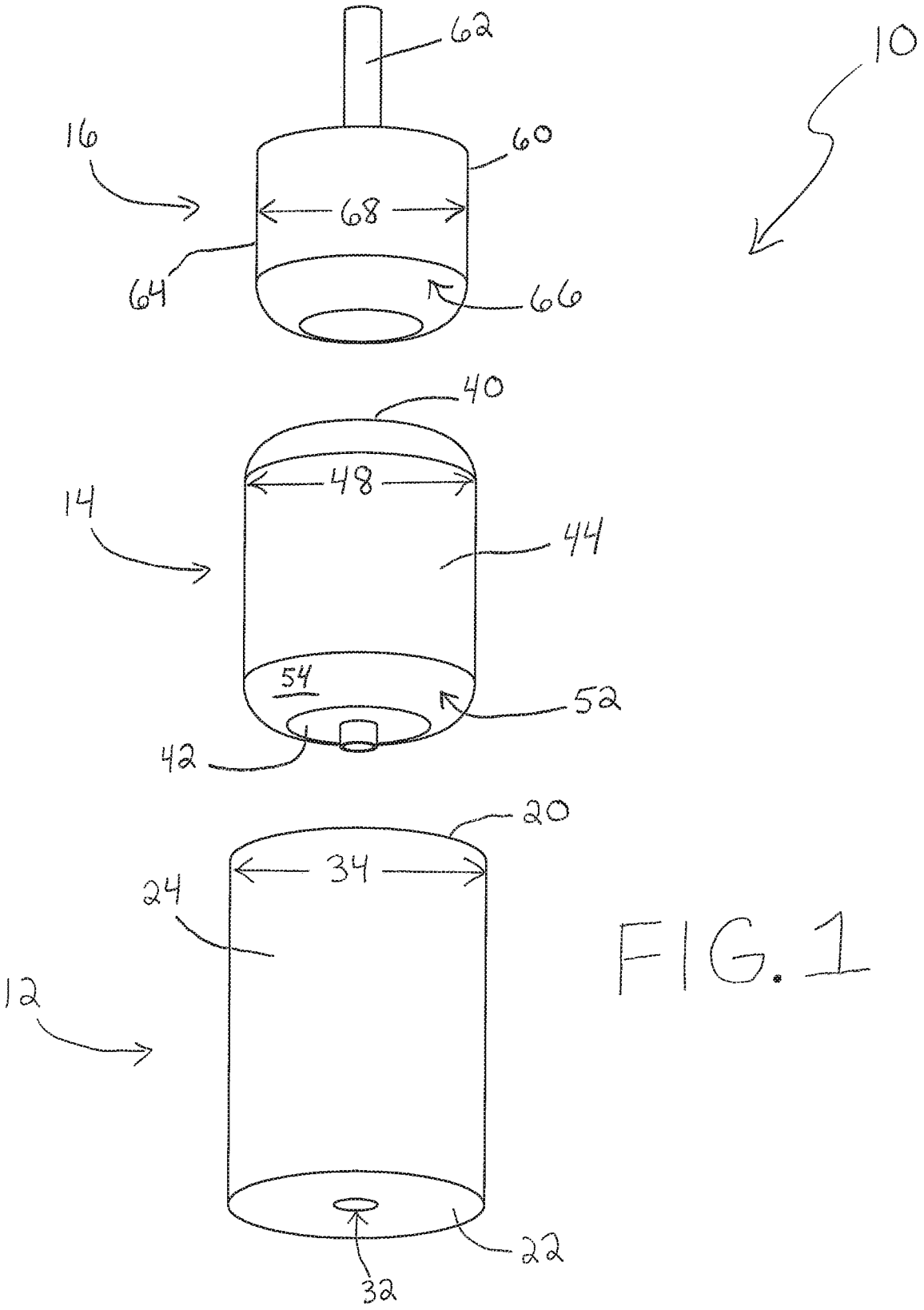
FIG. 1 is an exploded, perspective view of a substance dispensing system in accordance with an embodiment of the present invention.

The following description is provided to enable those skilled in the art to make and use the described embodiments contemplated for carrying out the invention. Various modifications, equivalents, variations, and alternatives, however, will remain readily apparent to those skilled in the art. Any and all such modifications, variations, equivalents, and alternatives are intended to fall within the spirit and scope of the present invention.

For purposes of the description hereinafter, the terms "upper", "lower", "right", "left", "vertical", "horizontal", "top", "bottom", "lateral", "longitudinal", and derivatives thereof shall relate to the invention as it is oriented in the drawing figures. However, it is to be understood that the invention may assume various alternative variations, except where expressly specified to the contrary. It is also to be understood that the specific devices illustrated in the attached drawings, and described in the following specification, are simply exemplary embodiments of the invention. Hence, specific dimensions and other physical characteristics related to the embodiments disclosed herein are not to be considered as limiting.

In the following discussion, "distal" refers to a direction generally toward a portion of a substance dispensing system in which a substance is expelled from a container, and "proximal" refers to the opposite direction of distal, i.e., away from the portion of the substance dispensing system in which a substance is expelled from a container. For purposes of this disclosure, the above-mentioned references are used in the description of the components of a substance dispensing system in accordance with the present disclosure.

FIGS. 1-7 illustrate exemplary embodiments of the present disclosure. Referring to FIGS. 1 and 3-7, substance dispensing system 10 includes confinement structure 12, container 14, and actuation member 16 as will be described in more detail below. Substance dispensing system 10 provides for controllable deformation of a container such that a portion of the container acts as a wiping means to empty a substance from the container. In this manner, substance dispensing system 10 provides a more efficient process of dispensing a substance from a container.

In the exemplary embodiment of FIGS. 1 and 3-7, confinement structure 12, container 14, and actuation member 16 are illustrated as elongated cylindrical members, though it is contemplated that other shapes and sizes of these components may be used. For example, confinement structure 12, container 14, and actuation member 16 can have other multi-sided polygon cross-sectional shapes, such as square, rectangular, or triangular cross-sectional shapes. Referring to FIG. 2, confinement structure 12A, container 14A, and actuation member 16A include elongated triangular members. The embodiment illustrated in FIG. 2 includes similar components to the embodiment illustrated in FIGS. 1 and 3-7, and the similar components are denoted by a reference number followed by the letter A. For the sake of brevity, these similar components and the similar steps of using substance dispensing system 10A (FIG. 2) will not all be discussed in conjunction with the embodiment illustrated in FIG. 2. Container 12 may also be available in a variety of shapes and sizes to accommodate a variety of substances as will be discussed in more detail below.

Figure 2:
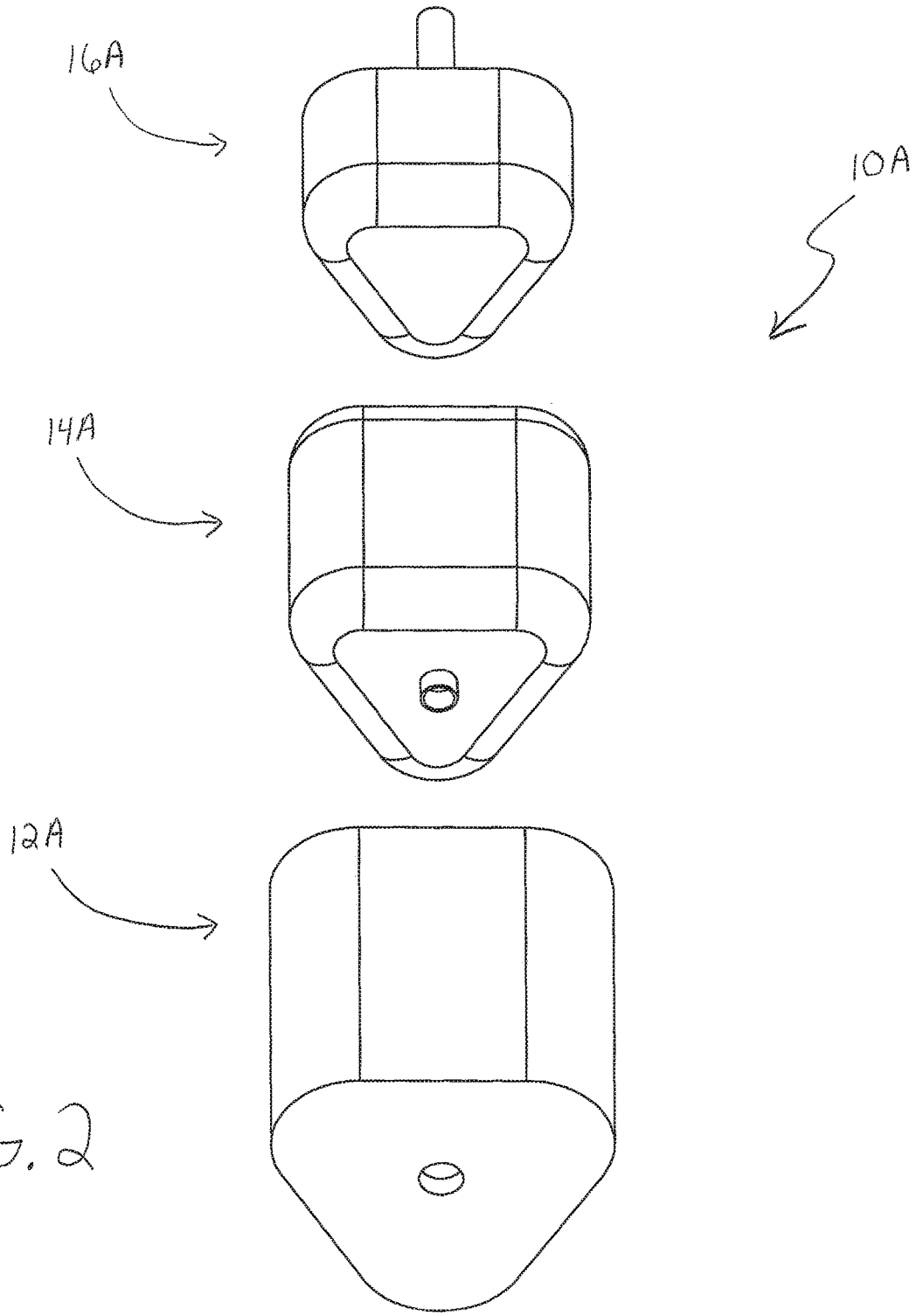
FIG. 2 is an exploded, perspective view of a substance dispensing system in accordance with another embodiment of the present invention.

Referring to FIGS. 1 and 3-7, confinement structure 12 includes proximal end 20, distal end 22, and sidewall 24 extending between proximal end 20 and distal end 22. Referring to FIGS. 3-6B, sidewall 24 of confinement structure 12 defines an interior 26 sized and shaped to receive container 14 and actuation member 16 as will be described in more detail below. Referring to FIGS. 3, 4A, 5A, and 6A, distal end 22 of confinement structure 12 defines an interior profile 28. For example, the interior wall surface 30 of distal end 22 of confinement structure 12 defines interior profile 28 of confinement structure 12. In one embodiment, proximal end 20 of confinement structure 12 includes an open end and distal end 22 of confinement structure 12 includes an exit portion or exit aperture 32. Referring to FIG. 1, proximal end 20 of confinement structure 12 defines a confinement structure diameter 34. In one embodiment, confinement structure diameter 34 is defined by interior wall surface 30 of confinement structure 12. In this manner, proximal end 20 of confinement structure 12 defines an interior confinement structure diameter 34 as shown in FIG. 1.

Referring to FIGS. 1 and 3-7, confinement structure 12 is configured with actuation member 16 to provide a substance dispensing system 10 that allows for controllable deformation of a container 14 such that a portion of the container 14 acts as a wiping means to empty a substance from the container 14. Confinement structure 12 has a sufficient rigidity to maintain a container 14 therein during controllable deformation of the container 14. Confinement structure 12 is capable of receiving a variety of different containers 14 containing a variety of substances.

Referring to FIGS. 1 and 3-7, container 14 includes first end 40, second end 42, and a deformable wall 44 extending between first end 40 and second end 42. Referring to FIGS. 3-6B, deformable wall 44 of container 14 defines a container interior 46 adapted to hold a substance 50. Container 14 is adapted to hold a variety of different substances. For example, container 14 is adapted to hold various adhesives, coatings, putties, and caulkings for a variety of different applications. Some one part and multiple component products which could be used with the present disclosure include noiseproofing compounds, glazing adhesives and sealants, chinking compounds, solar glass sealants, self-leveling sealants, composite construction adhesives coatings and compounds, flooring adhesives, roofing adhesives, roof coatings, masonry tuck pointing, mechanical equipment adhesives, architectural metal sealant, marine adhesives and coatings, waterproofing compounds, siding sealants, fabric adhesives, leather adhesives, vinyl adhesives, wood construction adhesives, wallpaper adhesives, firestopping adhesives and caulkings, silicone, grease, architectural railing systems, guardrail systems, automotive sealants and adhesives, manufacturing processes, door and window adhesives and sealants, EIFS adhesives and sealants, flooring sealants, truck bed liners, epoxies, rust proofing, para-methoxy-n-methylamphetamine (PMMA), acrylic caulkings, and polyurethane foam insulation. It is also contemplated that other substances such as foodstuffs could be used with the present disclosure.

Container 14 is sized and shaped to be positionable within interior 26 of confinement structure 12 as shown in FIGS. 3-6B. Referring to FIG. 1, first end 40 of container 14 defines a container diameter 48. Container 14 has a tear resistance sufficient to withstand tearing during a controlled deformation process.

Referring to FIGS. 1, 3, 4A, 5A, and 6A, second end 42 of container 14 defines a container profile 52. For example, the container wall surface 54 of second end 42 of container 14 defines container profile 52 of container 14. Referring to FIG. 1, in one embodiment, the container profile 52 of container 14 may be shaped to substantially correspond to interior profile 28 of confinement structure 12 with container 14 in an initial or undeformed configuration. However, in alternative embodiments, the container profile 52 of container 14 may be configured in a different shape than the interior profile 28 of confinement structure 12 with container 14 in an initial or undeformed configuration. In such an embodiment, with container 14 positioned within confinement structure 12, the walls of confinement structure 12 control the shape and deformation of container 14 because of the rigidity of the walls of confinement structure 12. For example, referring to FIGS. 3-6B, confinement structure 12 controls and maintains container 14 such that the shape of container profile 52 substantially corresponds to the interior profile 28 of confinement structure 12 during a controlled deformation process.

Referring to FIGS. 1 and 3-7, actuation member 16 includes head portion 60 and shaft portion 62. Actuation member 16 may be slidably or movably positionable within confinement structure 12. Head portion 60 of actuation member 16 is sized and shaped to contact first end 40 of container 14 to deform container 14 during a controlled deformation process as will be discussed in more detail below.

Shaft portion 62 of actuation member 16 is adapted to be placed in communication with a drive system for advancing actuation member 16 within confinement structure 12 between a first position (FIG. 3) in which actuation member 16 is adjacent proximal end 20 of confinement structure 12 and a second position (FIGS. 6A and 6B) in which actuation member 16 is adjacent distal end 22 of confinement structure 12. In this manner, with container 14 positioned within confinement structure 12, as actuation member 16 moves from the first position towards the second position, actuation member 16 deforms container 14 thereby expelling substance 50 from container 14. In one embodiment, the drive system may be a hydraulic drive system including a hydraulic cylinder in communication with shaft portion 62 of actuation member 16. However, it is envisioned that other drive systems may be used. For example, the drive system could include other mechanical and electrical drive systems. In one embodiment, a drive system of substance dispensing system 10 could be part of a hydraulic drive system in accordance with the hydraulic drive system described in the United States patent application filed concurrently herewith, entitled "Substance Dispensing System", and commonly assigned with the present application, the entire disclosure of which is hereby expressly incorporated herein by reference.

Figure 5A:
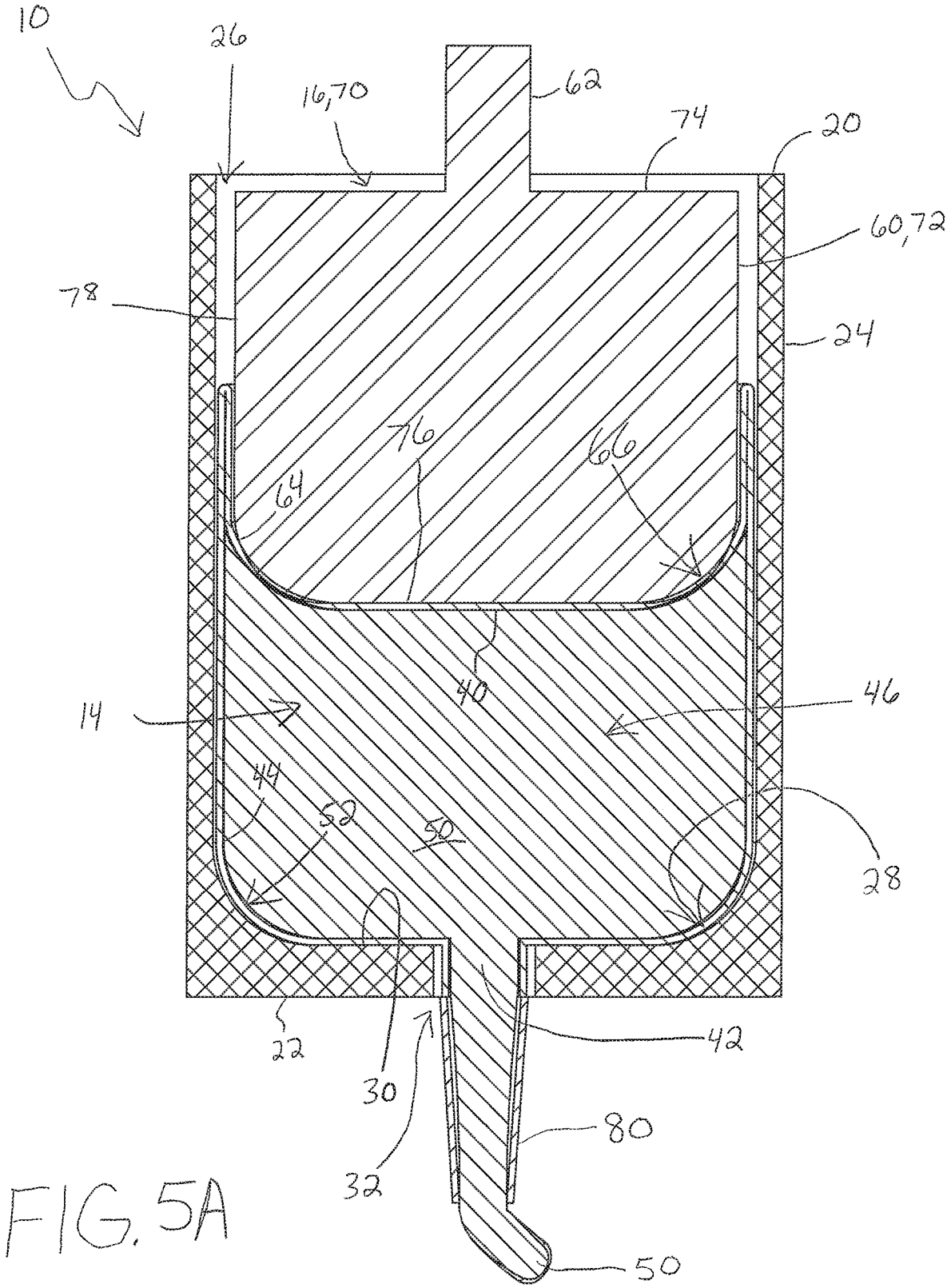
FIG. 5A is an assembled, cross-sectional view of the substance dispensing system of FIG. 1, with an actuation member in a second intermediate position deforming a portion of a container, illustrating a nozzle in fluid communication with the container in accordance with an embodiment of the present invention.

Head portion 60 of actuation member 16 includes exterior wall 64. Referring to FIGS. 3, 4A, 5A, and 6A, exterior wall 64 of actuation member 16 defines an exterior profile 66. In one embodiment, exterior profile 66 of actuation member 16 is shaped to substantially correspond to interior profile 28 of confinement structure 12. In this manner, actuation member 16 and confinement structure 12 together allow for substance 50 to be completely expelled from container 14 with actuation member 16 in the second position as shown in FIG. 6B, i.e., substance 50 is expelled from container 14 such that no significant portion of substance 50 remains within container 14 and is not expelled from container 14. Additionally, actuation member 16 is configured with confinement structure 12 to provide a substance dispensing system 10 that allows for controllable deformation of a container 14 such that a portion of the container 14 acts as a wiping means to empty a substance from the container 4 as described in more detail below.

Figure 3:
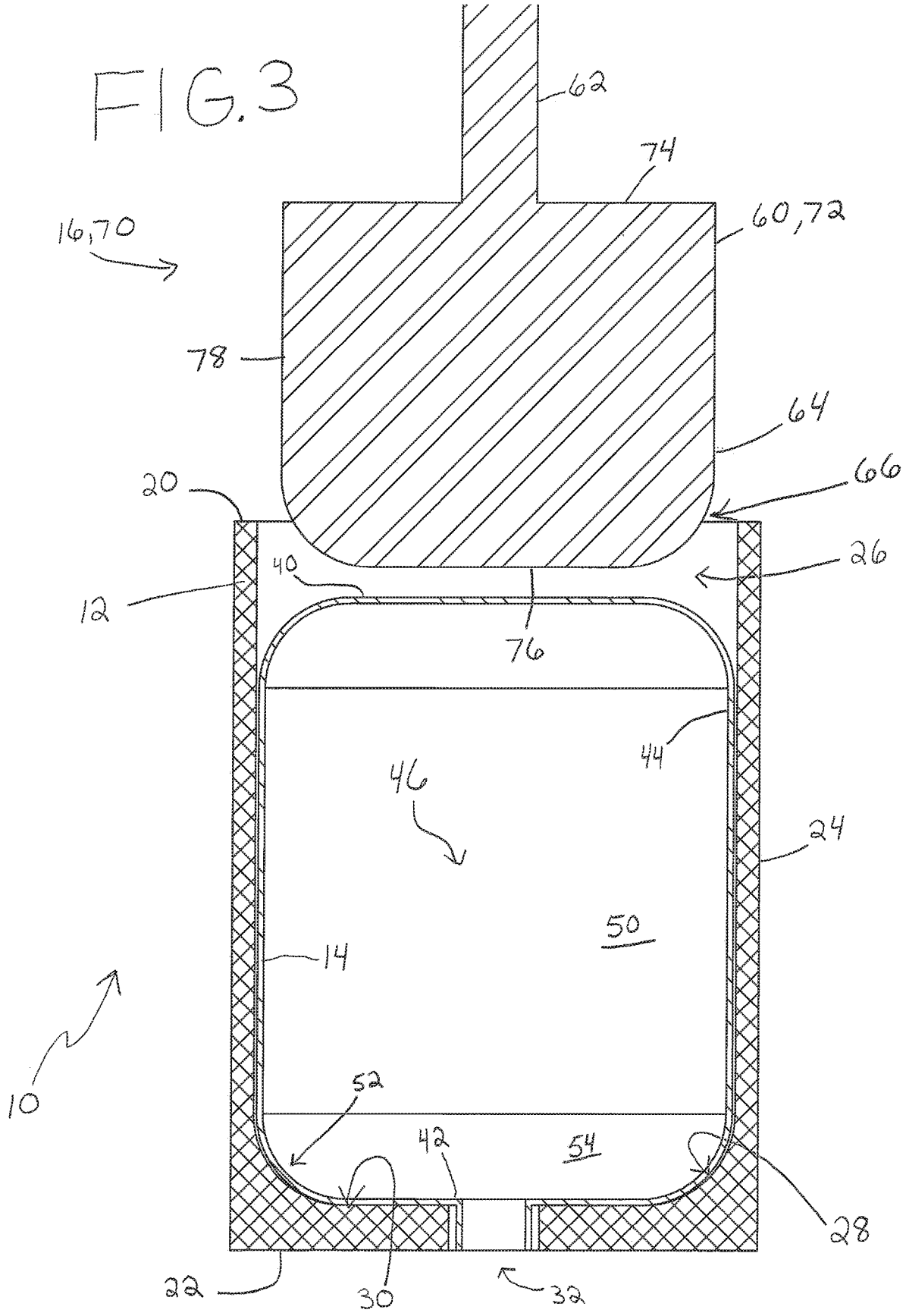
FIG. 3 is an assembled, cross-sectional view of the substance dispensing system of FIG. 1 with an actuation member in a first position in accordance with an embodiment of the present invention.

Referring to FIG. 1, head portion 60 of actuation member 16 defines an actuation member diameter 68. In one embodiment, actuation member diameter 68 is less than container diameter 48 and container diameter 48 is less than confinement structure diameter 34 as shown in FIG. 3. In this manner, substance dispensing system 10 allows for controllable deformation of a container 14 such that a portion of the container 14 acts as a wiping means to empty a substance from the container 14 as described in more detail below.

Referring to FIGS. 1 and 3-7, in one embodiment, actuation member 16 comprises a plunger 70. Plunger 70 includes plunger head portion 72 having a proximal wall 74, a distal wall 76, and a plunger sidewall 78 extending between proximal wall 74 and distal wall 76. In one embodiment, plunger sidewall 78 has a constant diameter between proximal wall 74 and distal wall 76 to control deformation of a container 14 such that a portion of the container 14 acts as a wiping means to empty a substance from the container 14 as described in more detail below. In one embodiment, exterior profile 66 of actuation member 16 is defined by distal wall 76 of plunger 70.

FIGS. 8-12 illustrate another exemplary embodiment of the present disclosure. Referring to FIGS. 8-12, substance dispensing system 200 includes confinement structure 202, first container 204, second container 206, first actuation member 208, and second actuation member 210. Substance dispensing system 200 provides for controllable deformation of two containers such that a portion of each container acts as a wiping means to empty a substance from each container. The embodiment illustrated in FIGS. 8-12 includes similar components to the embodiment illustrated in FIGS. 1-7. For the sake of brevity, these similar components and the similar steps of using substance dispensing system 200 (FIGS. 8-12) will not all be discussed in conjunction with the embodiment illustrated in FIGS. 8-12.

Referring to FIGS. 8-12, confinement structure 202 includes proximal end 220, distal end 222, and sidewall 224 extending between proximal end 220 and distal end 222. Sidewall 224 of confinement structure 202 defines an interior 226 including a first cavity 236 and a second cavity 238. In one embodiment, the first cavity 236 is sized and shaped to receive first container 204 and the second cavity 238 is sized and shaped to receive second container 206. The first cavity 236 defines a first cavity profile 237 and the second cavity 238 defines a second cavity profile 239. In one embodiment, confinement structure 202 is a single component defining first cavity 236 and second cavity 238. In other embodiments, confinement structure 202 may comprise a first confinement structure defining a first cavity 236 and a second confinement structure defining a second cavity 238.

Figure 12:
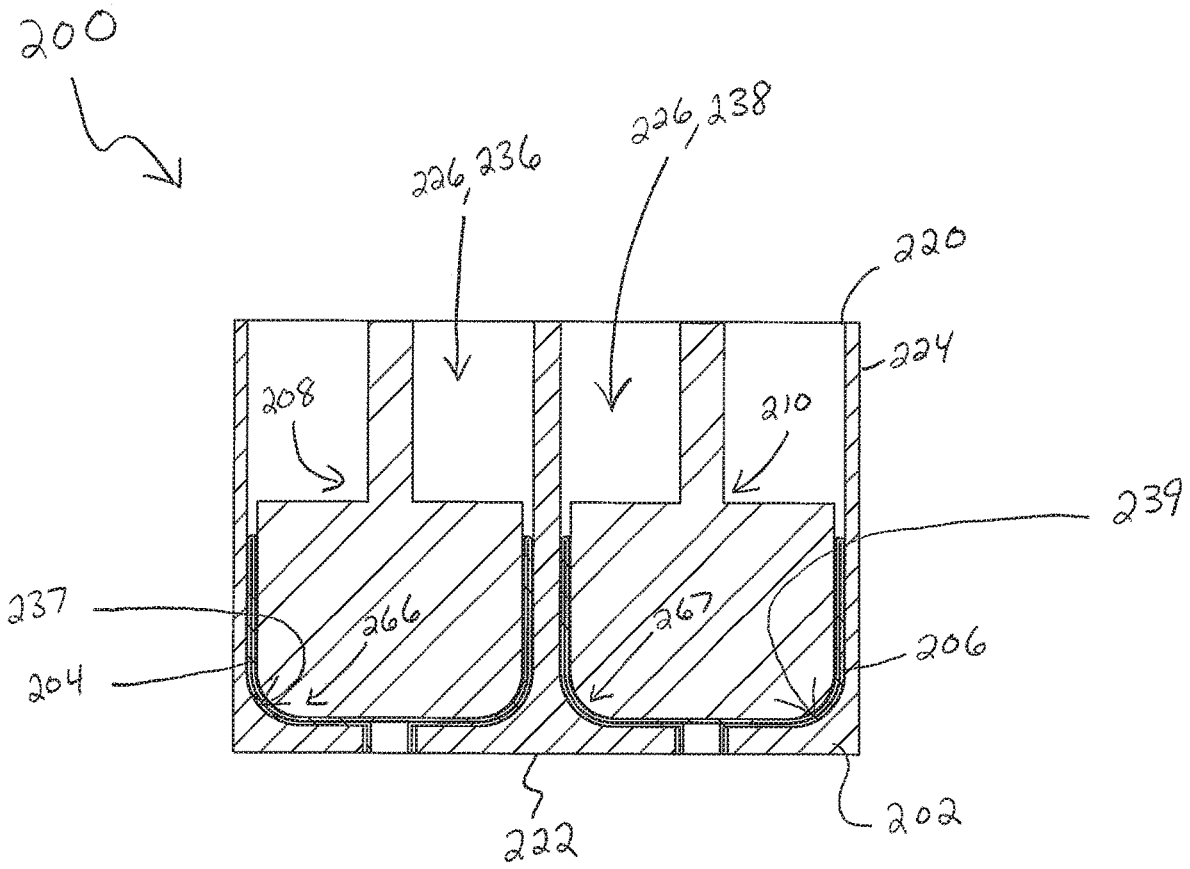
FIG. 12 is an assembled, cross-sectional view of the substance dispensing system of FIG. 8, with a first and second actuation member in a second position deforming a portion of a first and second container, respectively, in accordance with an embodiment of the present invention.

Referring to FIGS. 8-12, first actuation member 208 includes exterior wall 264 and second actuation member 210 includes exterior wall 265. Exterior wall 264 of first actuation member 208 defines an exterior profile 266 and exterior wall 265 of second actuation member 210 defines an exterior profile 267. In one embodiment, the exterior profile 266 of first actuation member 208 is shaped to substantially correspond to the first cavity profile 237 of first cavity 236 of confinement structure 202. The exterior profile 267 of second actuation member 210 is shaped to substantially correspond to the second cavity profile 239 of second cavity 238 of confinement structure 202. In this manner, actuation members 208 and 210 and confinement structure 202 together allow for a substance to be completely expelled from each of containers 204 and 206 with actuation members 208 and 210 in the second position as shown in FIG. 12, i.e., a substance is expelled from containers 204 and 206 such that no significant portion of a substance remains within containers 204 and 206 and is not expelled from containers 204 and 206.

Referring to FIGS. 8-12, first container 204 includes first end 240, second end 242, and a deformable wall 244 extending between first end 240 and second end 242. Deformable wall 244 of first container 204 defines a first container interior 246 adapted to hold a substance. First container 204 is adapted to hold a variety of different substances. For example, first container 204 is adapted to hold various adhesives, coatings, and caulkings for a variety of different applications. First container 204 is sized and shaped to be positionable within first cavity 236 of confinement structure 202 as shown in FIGS. 9-12. First container 204 has a tear resistance sufficient to withstand tearing during a controlled deformation process.

Referring to FIGS. 8-12, second container 206 includes first end 250, second end 252, and a deformable wall 254 extending between first end 250 and second end 252. Deformable wall 254 of second container 206 defines a second container interior 256 adapted to hold a substance. Second container 206 is adapted to hold a variety of different substances. For example, second container 206 is adapted to hold various adhesives, coatings, and caulkings for a variety of different applications. Second container 206 is sized and shaped to be positionable within second cavity 238 of confinement structure 202 as shown in FIGS. 9-12. Second container 206 has a tear resistance sufficient to withstand tearing during a controlled deformation process.

Referring to FIGS. 9-12, with first container 204 and second container 206 positioned within confinement structure 202, first actuation member 208 and second actuation member 210 are slidable or movable between the first position (FIG. 9) and the second position (FIG. 12).

Referring to FIGS. 8-12, first container 204 is shown with approximately the same size as second container 206. In this manner, a substance contained within first container 204 can be dispensed in a one to one (1:1) ratio with a substance contained within second container 206. In another embodiment, as shown in FIGS. 20A-23, substance dispensing system 200B includes a first container 204B having a different size than a second container 206B. Substance dispensing system 200B allows for a substance contained within first container 204B to be dispensed in varying ratios with a substance contained within second container 206B. Substance dispensing system 200B also provides for controllable deformation of two containers such that a portion of each container acts as a wiping means to empty a substance from each container. The embodiment illustrated in FIGS. 20A-23 includes similar components to the embodiment illustrated in FIGS. 8-12. For the sake of brevity, these similar components and the similar steps of using substance dispensing system 200B (FIGS. 20A-23) will not all be discussed in conjunction with the embodiment illustrated in FIGS. 20A-23.

Figure 21:
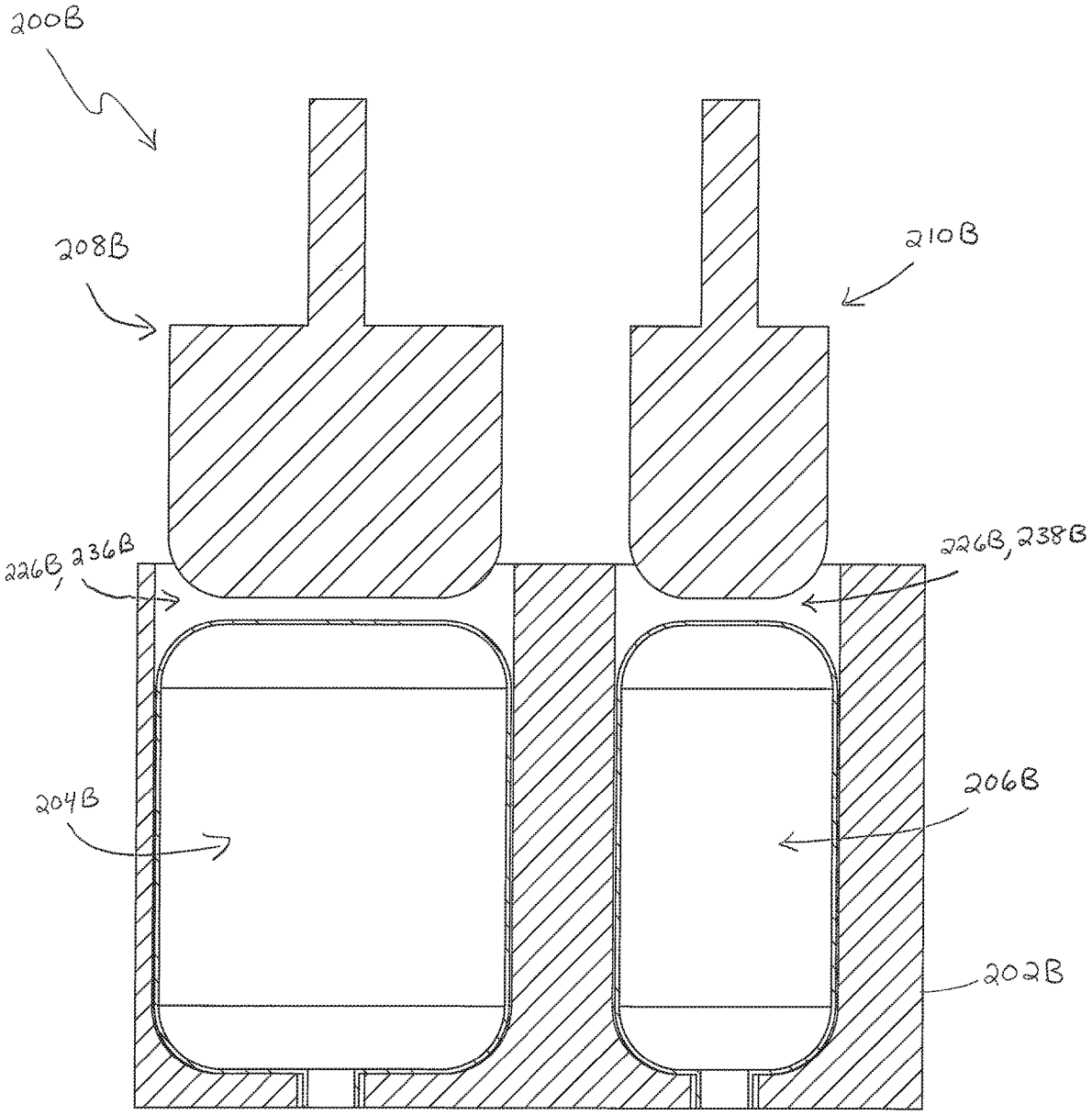
FIG. 21 is an assembled, cross-sectional view of the substance dispensing system of FIG. 20A with a first and second actuation member in a first position in accordance with an embodiment of the present invention.
Figure 22:
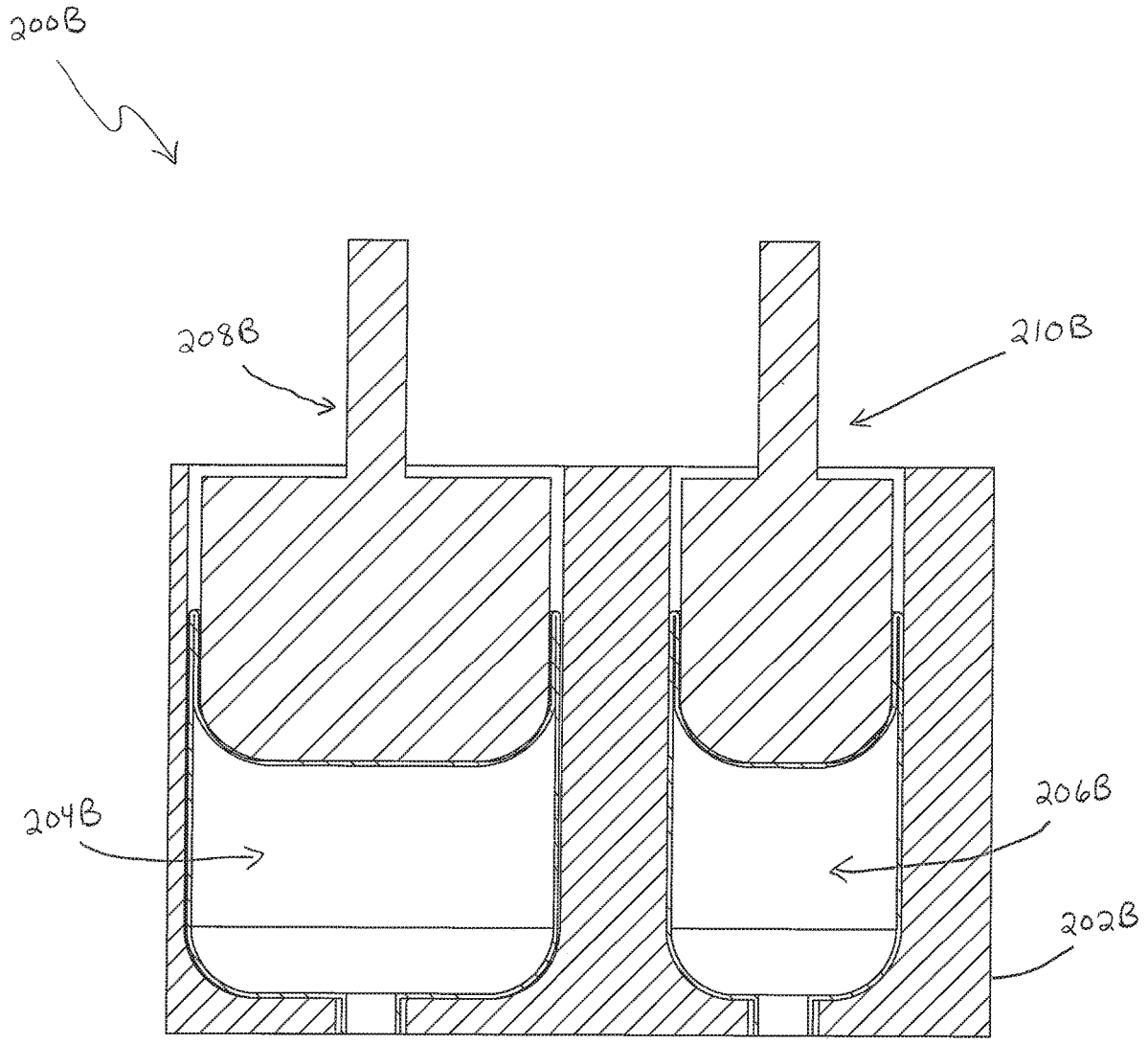
FIG. 22 is an assembled, cross-sectional view of the substance dispensing system of FIG. 20A, with a first and second actuation member in an intermediate position deforming a portion of a first and second container, respectively, in accordance with an embodiment of the present invention.
Figure 23:
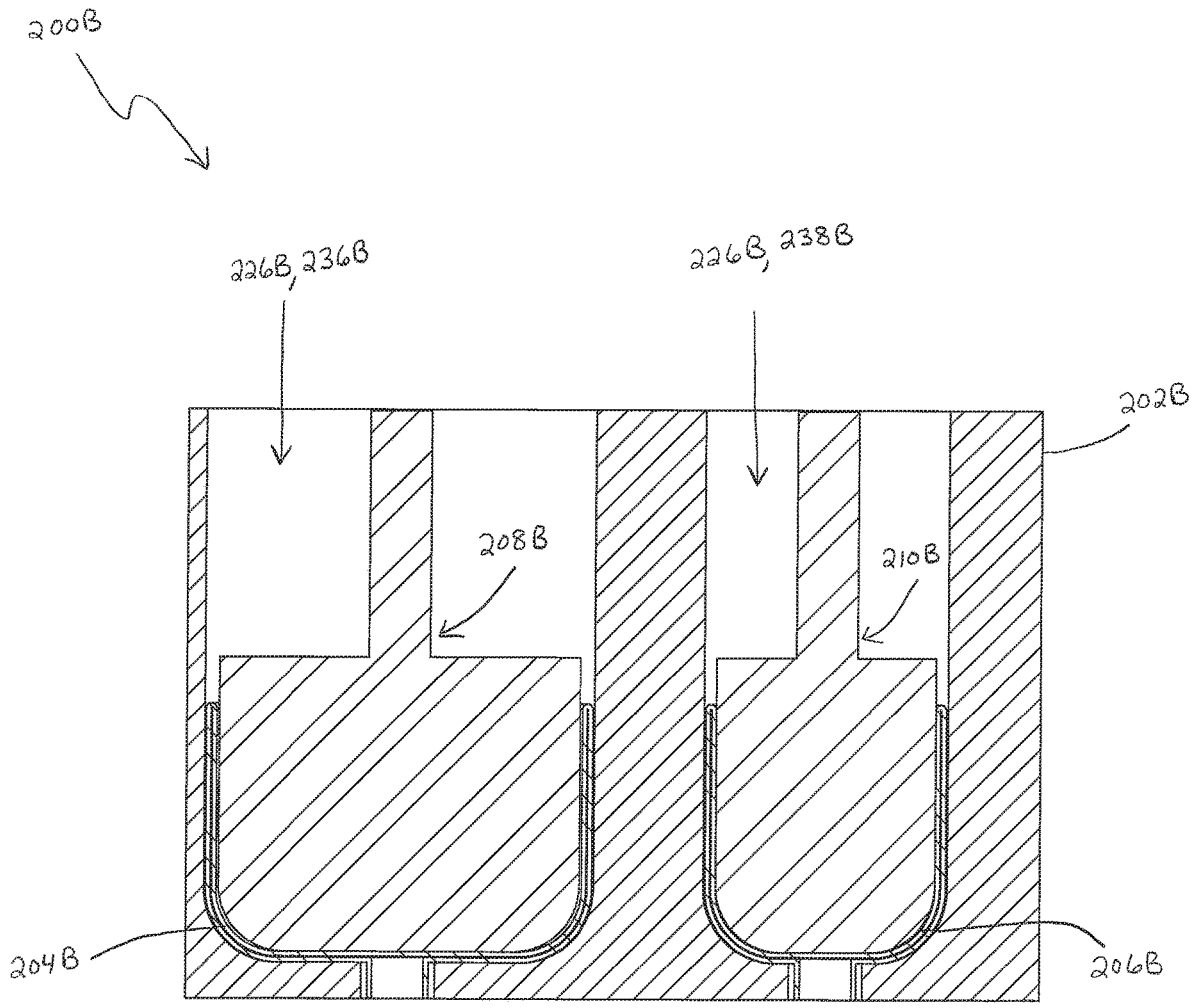
FIG. 23 is an assembled, cross-sectional view of the substance dispensing system of FIG. 20A, with a first and second actuation member in a second position deforming a portion of a first and second container, respectively, in accordance with an embodiment of the present invention.

Referring to FIGS. 1 and 3-7, use of substance dispensing system 10 to controllably deform a container 14 such that a portion of the container 14 acts as a wiping means to empty a substance 50 from the container 14 will now be described. For the sake of brevity, the components of substance dispensing system 10 will be referenced while describing the use of a substance dispensing system in accordance with the present disclosure as the components of substance dispensing system 200 (FIGS. 8-12) are used in a similar manner as illustrated in FIGS. 9-12 and as the components of substance dispensing system 200B (FIGS. 20A-23) are also used in a similar manner as illustrated in FIGS. 21-23.

As discussed above, a variety of different containers 14 containing various substances are compatible with the substance dispensing system 10 of the present disclosure. Actuation member 16 and confinement structure 12 provide a system 10 that allows for controllable deformation of a variety of different containers. With a particular container 14 containing a desired substance 50 to be expelled selected, the container 14 may be positioned within the interior 26 of confinement structure 12 as shown in FIG. 3.

In some embodiments, it may be desirable for the substance 50 to exit container 14 adjacent or approximately adjacent exit aperture 32 of confinement structure 12. For example, it may be desirable for the substance 50 within container 14 to be expelled from container 14 not more than approximately three (3) inches from second end 42 of container 14. When a substance 50 such as an adhesive is to be placed on small easily movable parts that are to be assembled, the parts can be moved in close proximity to the exit aperture 32. As the adhesive is expelled, it is applied to the parts being assembled and held together by the adhesive. In some embodiments, this immediate dispensing on to a part that is easily moved to the exit aperture requires no other fitment.

Figure 6A:
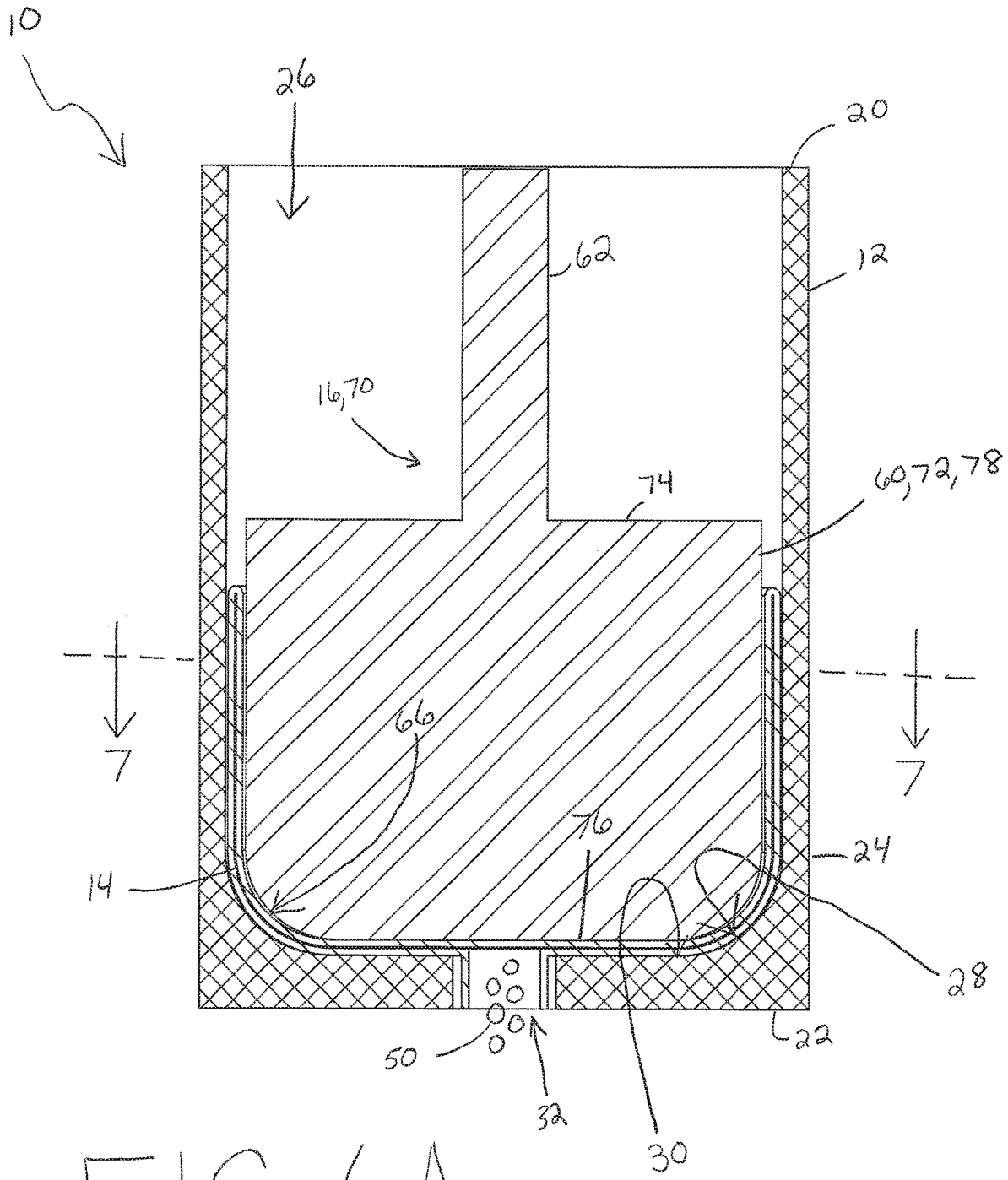
FIG. 6A is an assembled, cross-sectional view of the substance dispensing system of FIG. 1 with an actuation member in a second position deforming a portion of a container in accordance with an embodiment of the present invention.
Figure 6B:
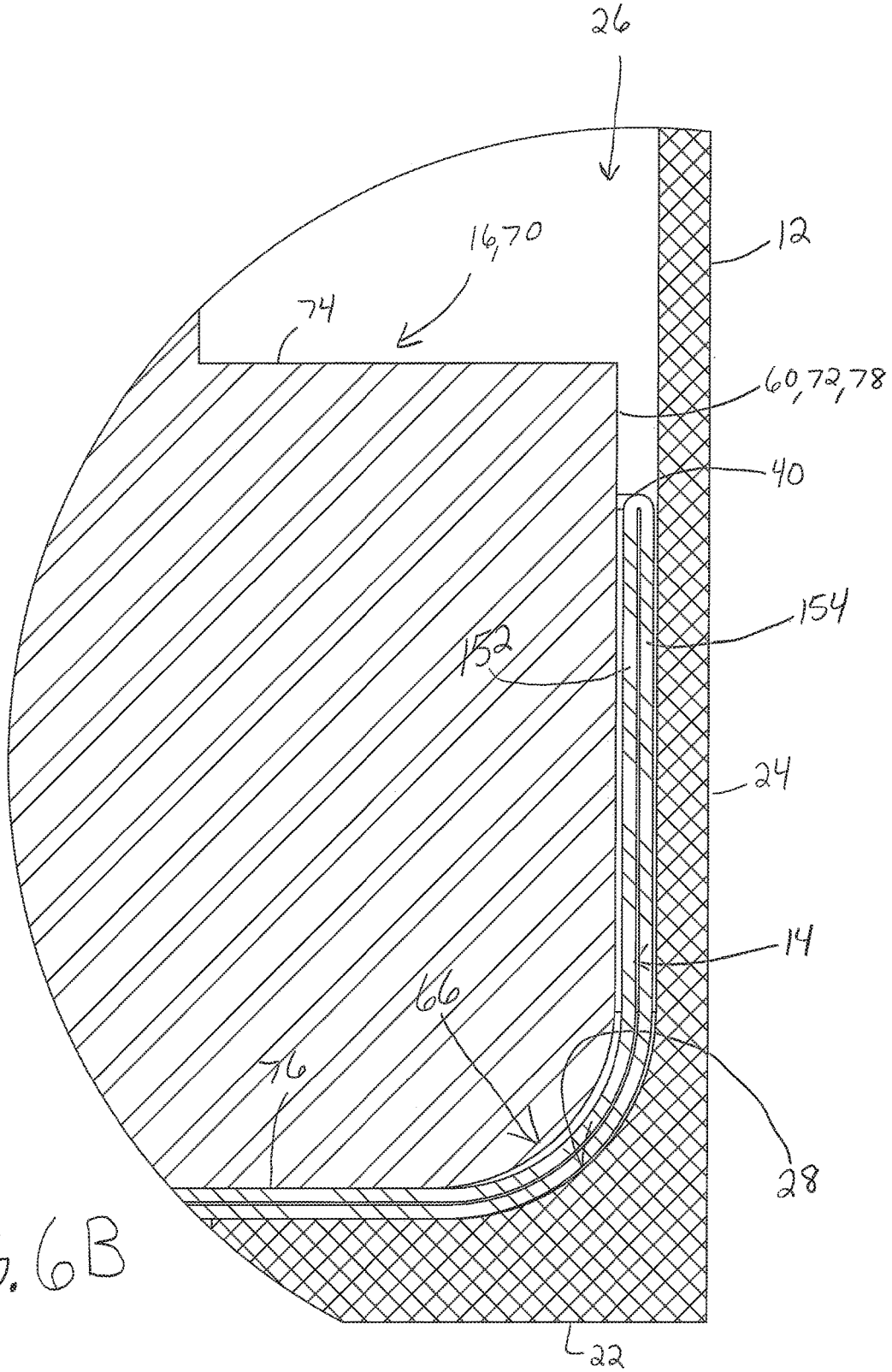
FIG. 6B is an enlarged, partial cross-sectional view of the substance dispensing system of FIG. 6A with an actuation member in a second position deforming a portion of a container in accordance with an embodiment of the present invention.

In one embodiment, referring to FIG. 6A, a substance 50 may be expelled from container 14 and out exit aperture 32 of confinement structure 12. In another embodiment, referring to FIG. 5A, a nozzle 80 may be placed in communication with second end 42 of container 14. For example, when placing a substance 50 on a substrate either the substance 50 or the substrate or both must be movable and positionable to allow for the mating of the substance 50 to the substrate. When a substance 50, such as a caulking, is to be placed in an expansion joint of a concrete substrate, the location of the expansion joint is neither movable nor positionable. The components of substance dispensing system 10 can be fitted with a nozzle 80 and can be placed on a movable frame such as a wheeled cart. The cart and the dispensing system 10 may be situated so that the tip opening of the nozzle 80 may be placed in the opening of the expansion joint. The nozzle 80 directs the caulking to be expelled into the expansion joint opening. As the movable frame is pulled along in a direction parallel to the expansion joint, the tip of the nozzle 80 is capable of moving and/or sliding in the opening. The caulking is expelled out of the nozzle 80 and fills the expansion joint. When a smaller opening in the concrete requires less caulking, a smaller nozzle 80 with a smaller tip opening can be utilized to reduce the size of the bead diameter.

Figure 5B:
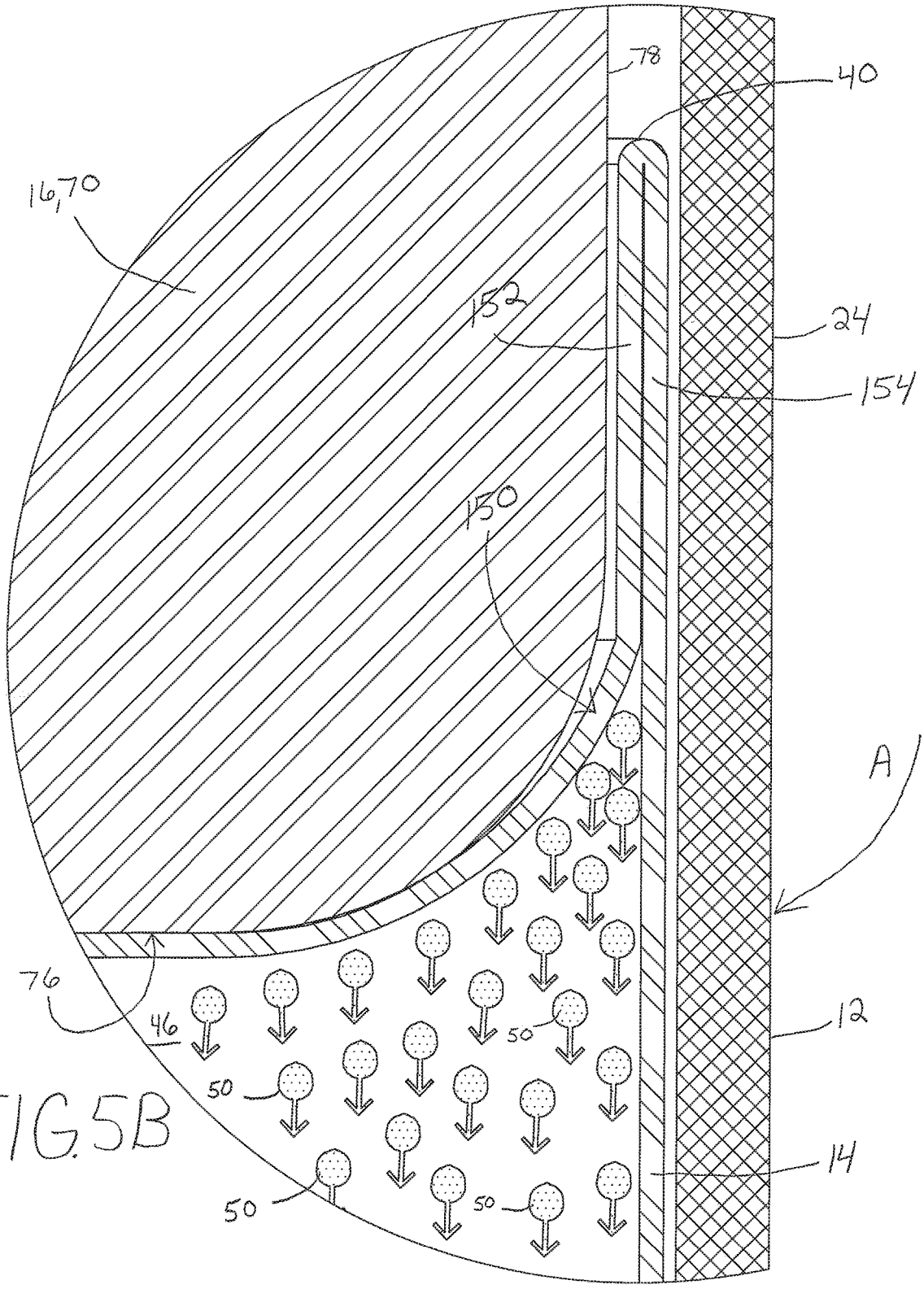
FIG. 5B is an enlarged, partial cross-sectional view of the substance dispensing system of FIG. 5A, with an actuation member in a second intermediate position deforming a portion of a container, illustrating the actuation member controllably deforming the container such that a deformed portion of the container acts as a wiping means to empty a substance from the container in accordance with an embodiment of the present invention.
Figure 5C:
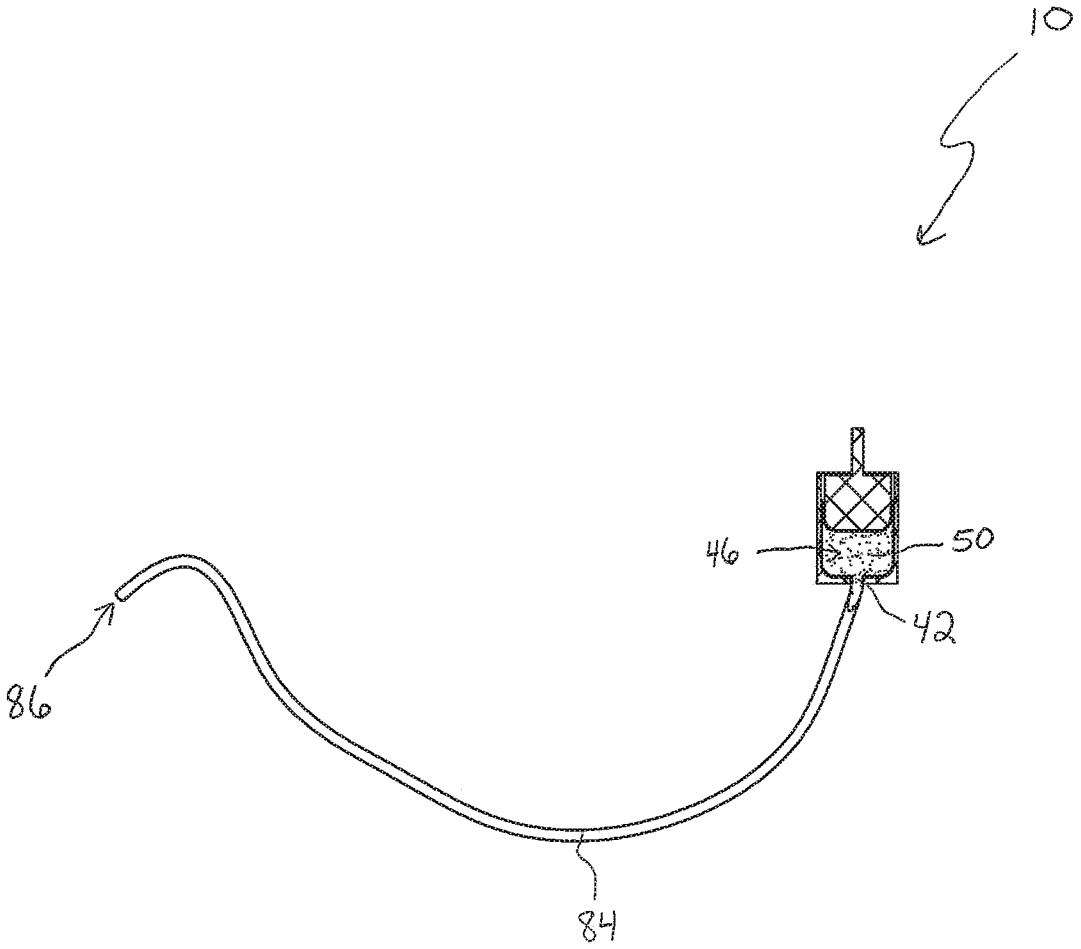
FIG. 5C is an assembled, cross-sectional view of the substance dispensing system of FIG. 1, with an actuation member in a second intermediate position deforming a portion of a container, illustrating a hose in fluid communication with the container in accordance with an embodiment of the present invention.

In some embodiments, it may be desirable for the substance 50 to exit container 14 and travel through a channel or flexible tubing, such as hose 84, for a distance before being dispensed as shown in FIG. 5C. In one embodiment, it may be desirable for the substance 50 within container 14 to be expelled from container 14 more than approximately three (3) inches from second end 42 of container 14. For example, at a construction site, it is often desirable to drill multiple holes in concrete and then fill those holes with an adhesive to hold a fastener. Placing the components of the substance dispensing system 10 and the actuating drive system to the exact location of each hole would be cumbersome, Holes are frequently required in vertical surfaces such as when mounting guardrails. It is not practical to maneuver all the components of the substance dispensing system 10 into a position to dispense adhesive into each hole. It is advantageous to attach a flexible hose, such as hose 84, to the dispensing container. The flexible tubing can be easily positioned at the exact location of each hole and thereby expel the adhesive into the hole. The present disclosure provides a substance dispensing system 10 that needs only be in the vicinity of the holes and the adhesive can then travel a distance in the tubing to reach the exact location of each hole.

In one embodiment, referring to FIG. 5C, a hose 84 may be placed in communication with second end 42 of container 14 such that container interior 46 is in fluid communication with an exit portion 86 of hose 84 via the hose 84. In this manner, a substance 50 may travel a desired distance away from substance dispensing system 10 before being dispensed. For example, when applying a roofing system, many adhesives and coatings are dispensed onto a large substrate. Frequently, adhesive manufacturers specify exact patterns of application for their adhesives. Insulation adhesive, for instance, must be applied in a ribbon or bead pattern with exact spacing. A common pattern requires that a 4 foot by 4 foot insulation board be adhered by placing ribbons or beads of adhesive no more than twelve (12) inches apart, Frequently, a serpentine pattern is used to place the adhesive in a continuous bead over the surface of a substrate. It is not practical to move the entire substance dispensing system 10 and the drive system in this serpentine pattern to dispense the adhesive per the manufacturers' specifications. By attaching a flexible hose 84 to the container 14, the adhesive can travel a distance from the components of the substance dispensing system 10 to the desired location. As the operator moves the exit portion 86 of hose 84 in the specified pattern, the adhesive exits the exit portion 86 and is placed in the pattern as specified. The addition of the flexible hose which requires the adhesive to travel a distance before exiting the dispensing system requires more force from the actuating member and the drive system. The increased force causes the pressure against the container interior 46 and the confinement structure 12 to increase. Prior art systems fail when this pressure is applied and the prior art systems are therefore not sufficient to perform such operations.

Figure 13A:
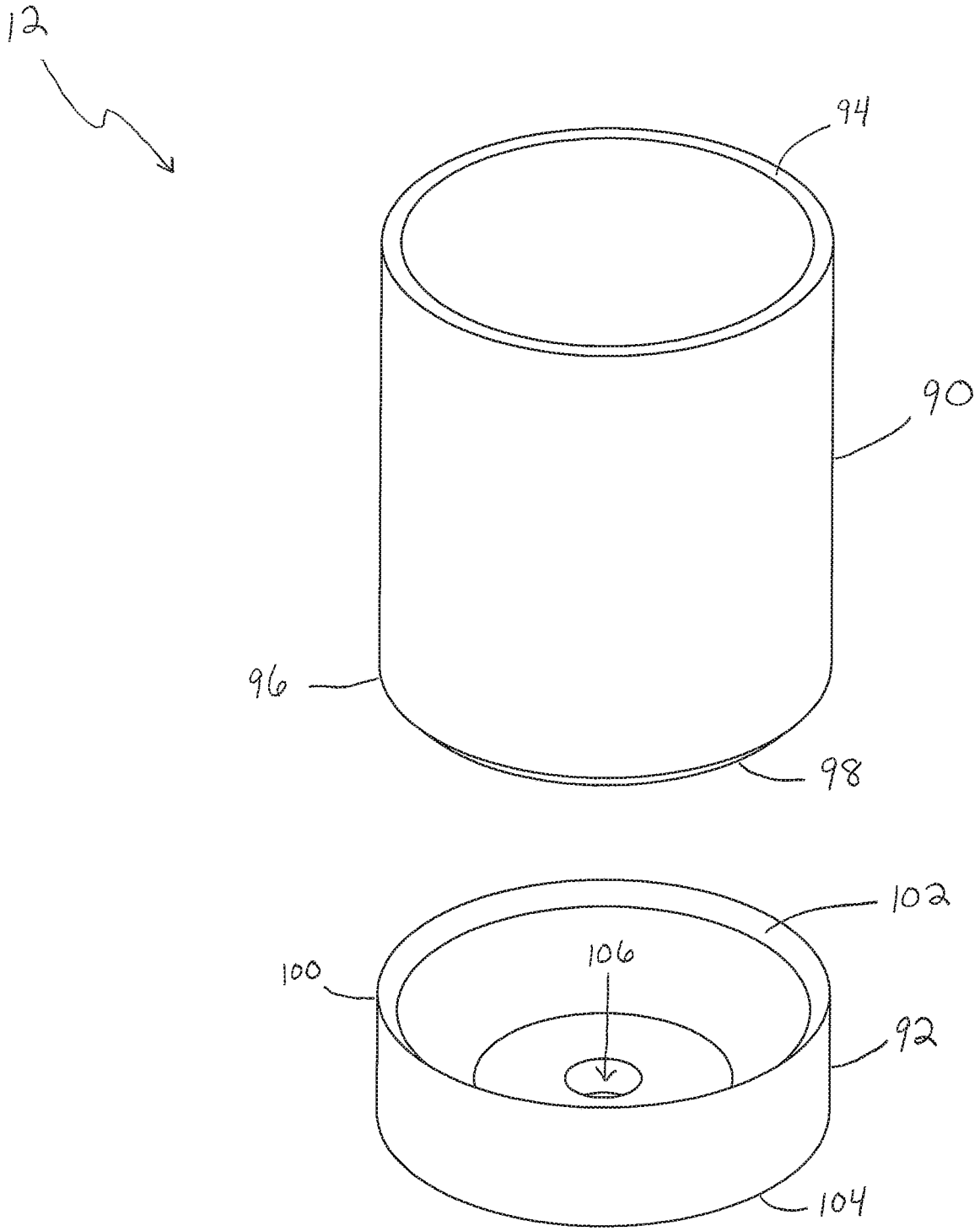
FIG. 13A is an exploded, perspective view of a confinement structure in accordance with an embodiment of the present invention.
Figure 13B:
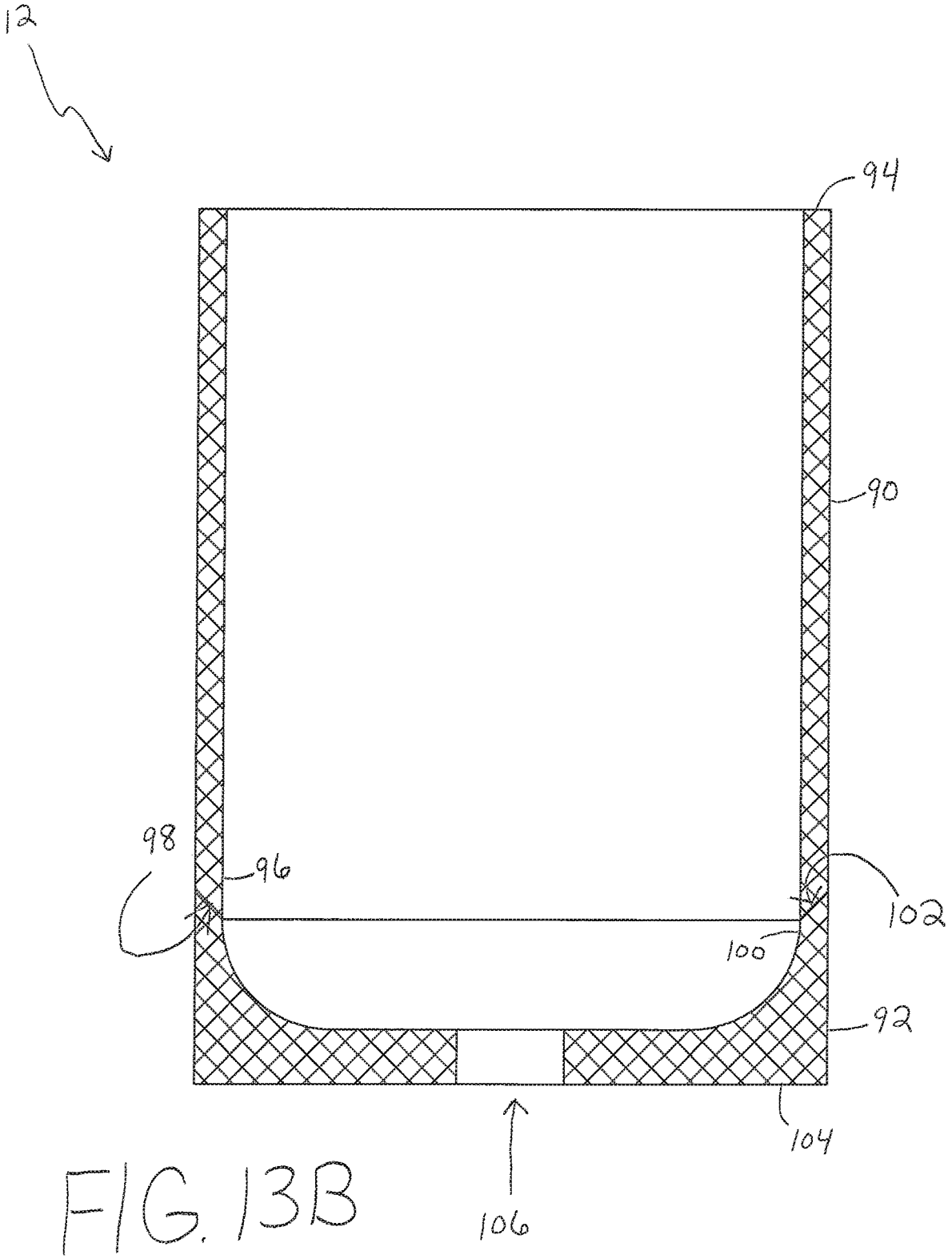
FIG. 13B is an assembled, cross-sectional view of the confinement structure of FIG. 13A in accordance with an embodiment of the present invention.

Referring to FIGS. 1-7, in one embodiment, confinement structure 12 comprises a single component. Referring to FIGS. 13A and 13B, in another embodiment, confinement structure 12 includes a top or container receiving portion 90 and a bottom or base portion 92. Top portion 90 includes proximal end 94 and distal end 96 having a first angled securement portion 98. Base portion 92 includes proximal end 100 having a second angled securement portion 102 and distal end 104 including exit aperture 106. In this embodiment, referring to FIG. 13B, top portion 90 is securable to base portion 92 via engagement of corresponding first and second angled securement portions 98 and 102. Advantageously, this embodiment of confinement structure 12 allows a container 14 containing a substance 50 to be positioned within top portion 90 of confinement structure 12 without base portion 92 being attached to top portion 90. In this manner, after a container 14 is properly positioned within top portion 90, then base portion 92 of confinement structure 12 can be securely attached to top portion 90. This allows for easier positioning of container 14 within confinement structure 12.

Figure 14A:
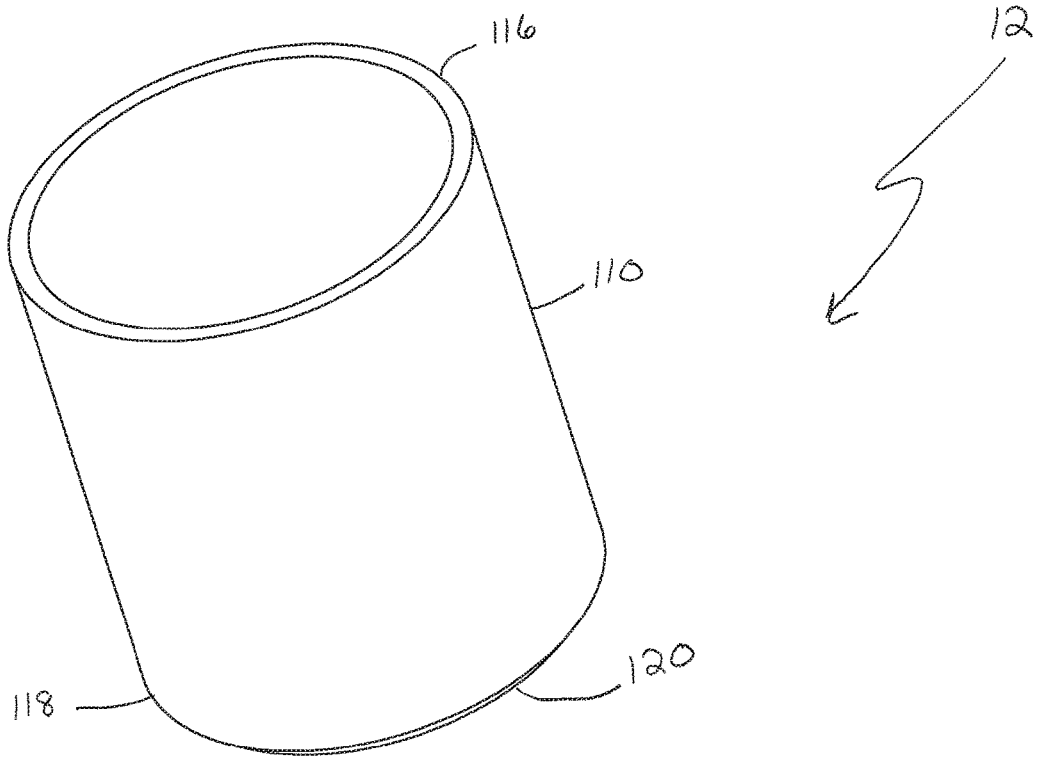
FIG. 14A is an exploded, perspective view of a confinement structure in accordance with another embodiment of the present invention.
Figure 14A:
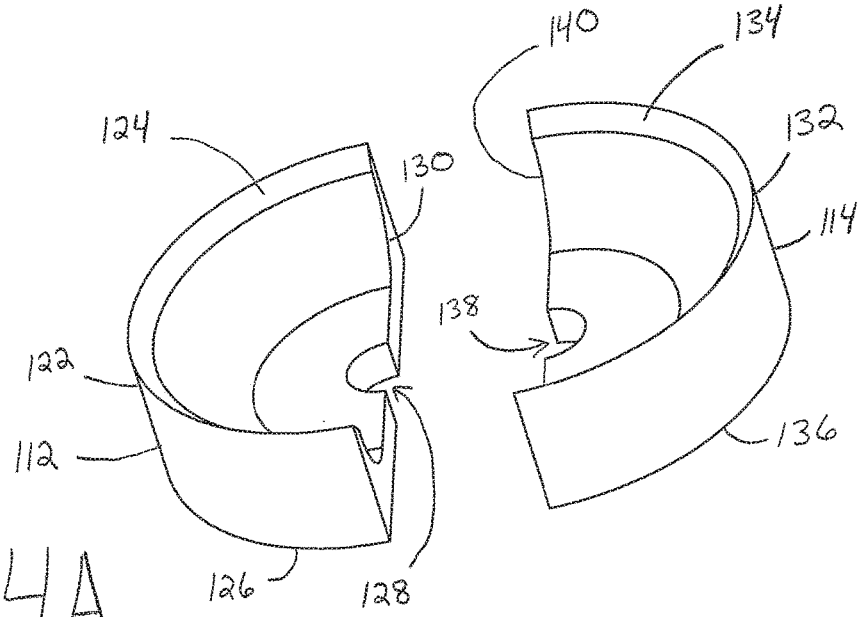
Figure 14B:
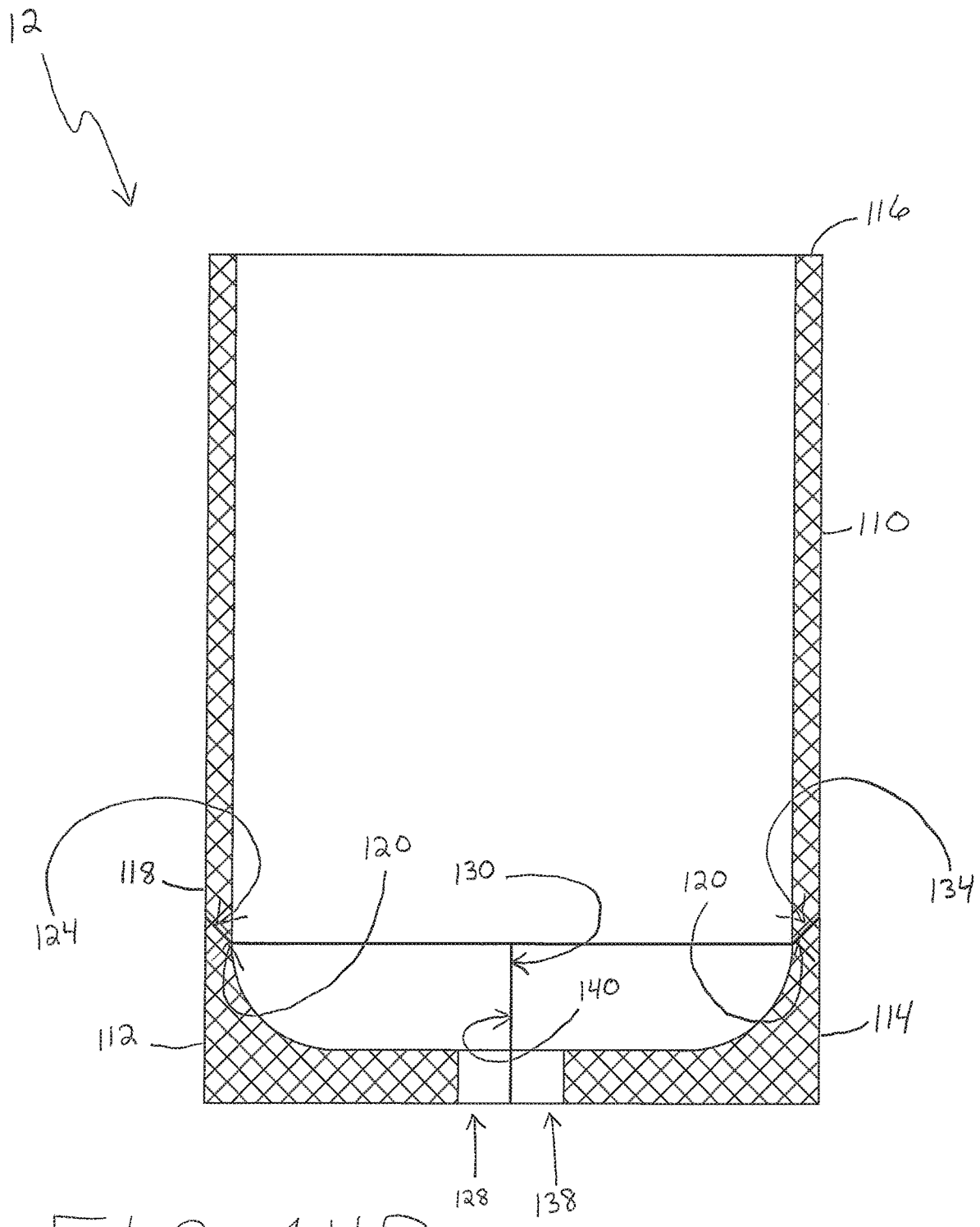
FIG. 14B is an assembled, cross-sectional view of the confinement structure of FIG. 14A in accordance with another embodiment of the present invention.

Referring to FIGS. 14A and 14B, in another embodiment, confinement structure 12 includes a top or container receiving portion 110, a first base portion 112, and a second base portion 114. Top portion 110 includes proximal end 116 and distal end 118 having a first angled securement portion 120. First base portion 112 includes first base proximal end 122 having a second angled securement portion 124 and distal end 126 including first exit aperture portion 128. In one embodiment, first base portion 112 also includes first base connection portion 130 for securing first base portion 112 with second base portion 114. Second base portion 114 includes second base proximal end 132 having a third angled securement portion 134 and distal end 136 including second exit aperture portion 138. In one embodiment, second base portion 114 also includes second base connection portion 140 for securing second base portion 114 with first base portion 112. In this embodiment, referring to FIG. 14B, top portion 110 is securable to first base portion 112 and second base portion 114 via engagement of corresponding first, second, and third angled securement portions 120, 124, and 134. In one embodiment, first base portion 112 is securable to second base portion 114 via engagement of corresponding first and second base connection portions 130 and 140. In one embodiment, base connection portions 130 and 140 may include threaded portions, respectively, which are threadingly engageable with one another to secure first base portion 112 to second base portion 114, In other embodiments, base connection portions 130 and 140 may include snap fit mechanisms, locking tabs, latch, adhesive, or other similar mechanism. Advantageously, this embodiment of confinement structure 12 allows a container 14 containing a substance 50 to be positioned within top portion 110 of confinement structure 12 without first and second base portions 112 and 114 being attached to top portion 110. In this manner, after a container 14 is properly positioned within top portion 110, then first and second base portions 112 and 114 of confinement structure 12 can be securely attached to top portion 110. This allows for easier positioning of container 14 within confinement structure 12. Furthermore, this embodiment of confinement structure 12 allows a portion of flexible tubing 82 or a portion of hose 84 to be positioned between first exit aperture portion 128 and second exit aperture portion 138 before first base portion 112 and second base portion 114 are secured together.

Referring to FIG. 3, with container 14 positioned within interior 26 of confinement structure 12, actuation member 16 may be placed relative to container 14 such that actuation member 16 is slidable or movable between a first position (FIG. 3) in which actuation member 16 is adjacent first end 40 of container 14 and a second position (FIGS. 6A and 6B) in which actuation member 16 is adjacent second end 42 of container 14. In one embodiment, the first position is an initial position and the second position is a position in which container 14 has been fully deformed and substance 50 has been completely expelled from container 14, i.e., substance 50 is expelled from container 14 such that no significant portion of substance 50 remains within container 14 and is not expelled from container 14.

Figure 4A:
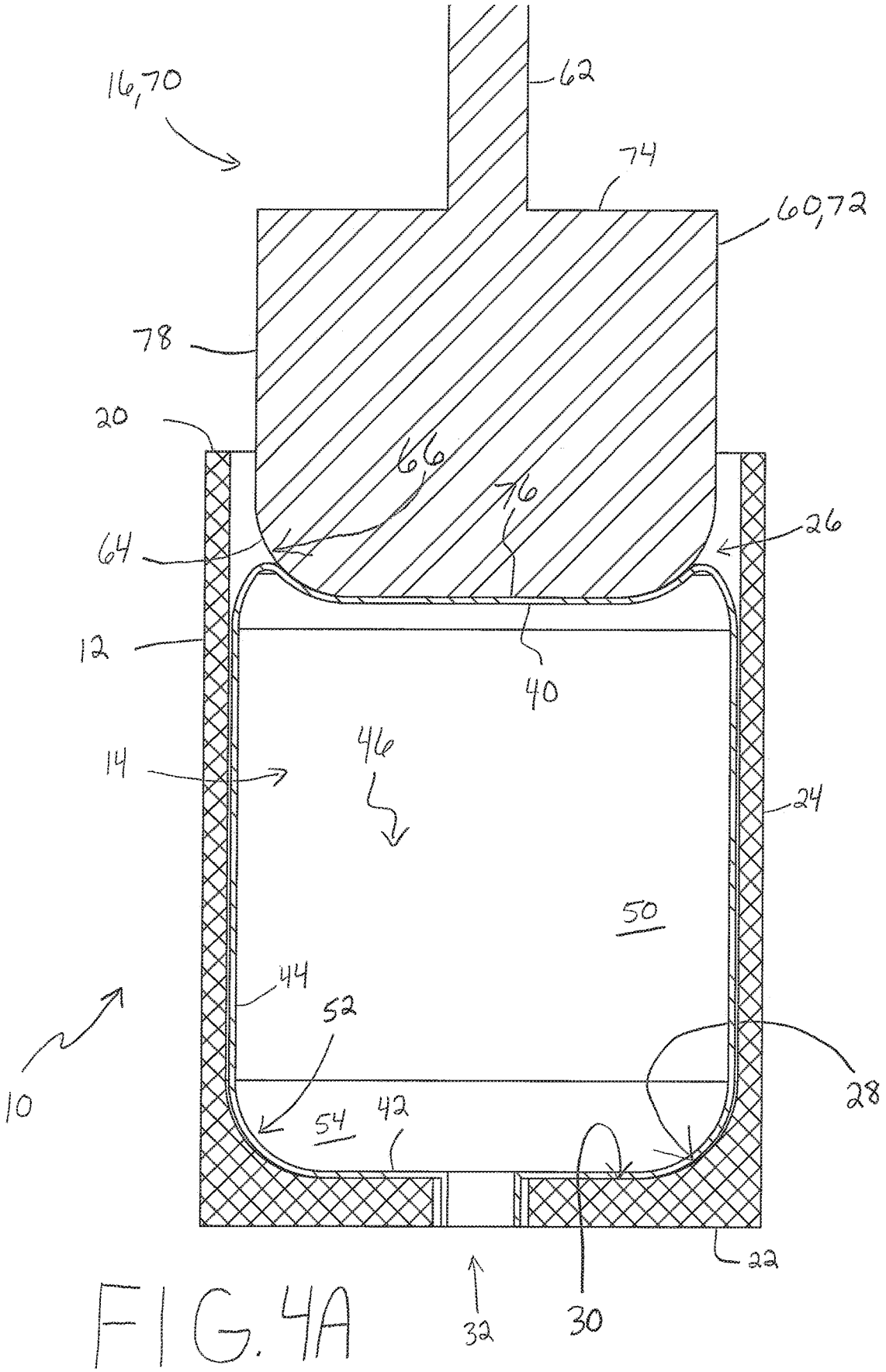
FIG. 4A is an assembled, cross-sectional view of the substance dispensing system of FIG. 1 with an actuation member in a first intermediate position deforming a portion of a container in accordance with an embodiment of the present invention.
Figure 4B:
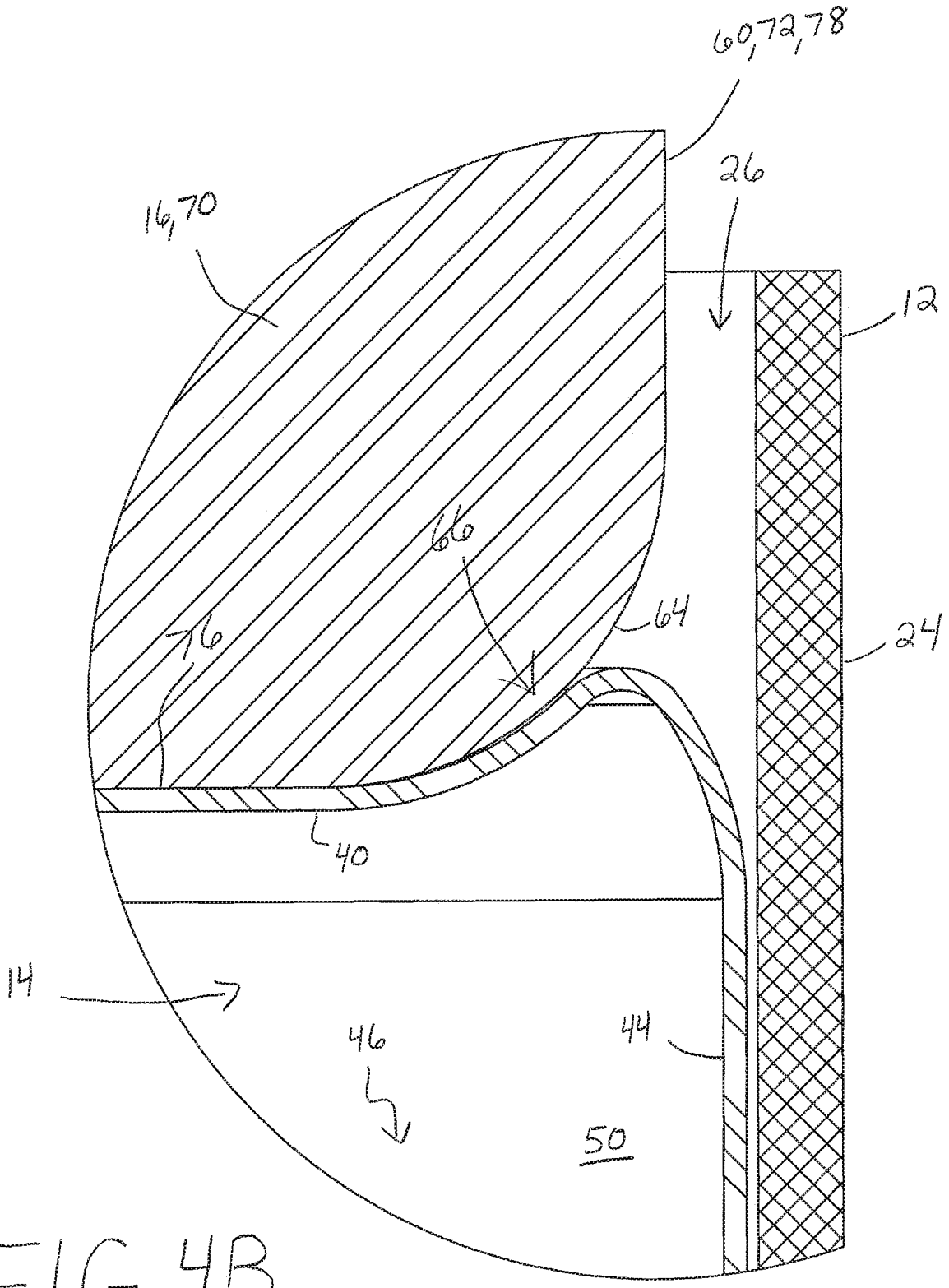
FIG. 4B is an enlarged, partial cross-sectional view of the substance dispensing system of FIG. 4A with an actuation member in a first intermediate position deforming a portion of a container in accordance with an embodiment of the present invention.

Next, referring to FIGS. 3-4B, a drive system as discussed above may be used to begin advancing actuation member 16 from the first position (FIG. 3) towards the second position. As actuation member 16 moves from the first position towards the second position, actuation member 16 deforms container 14 to begin expelling substance 50 from container 14. In one embodiment, a valve may be placed in communication with second end 42 of container 14. The valve may be operable between an open position in which substance 50 is able to flow out container 14 and a closed position in which substance 50 is maintained within container 14.

Referring to FIGS. 5A and 5B, as actuation member 16 continues to slide or move from the first position towards the second position, actuation member 16 controllably deforms container 14 such that a portion of first end 40 of container 14 extends past actuation member 16 and acts as a wiping means to empty substance 50 from container 14. For example, in one embodiment, a portion of first end 40 of container 14 extends past distal wall plunger 70 towards proximal wall 74 of plunger 70 as shown in FIGS. 5A and 5B.

The portion of first end 40 of container 14 that extends past distal wall 76 of plunger 70 towards proximal wall 74 of plunger 70 is disposed between sidewall 24 of confinement structure 12 and plunger sidewall 78 as shown in FIGS. 5A and 5B. With the portion of first end 40 of container 14 extending past distal wall 76 of plunger 70 towards proximal wall 74 of plunger 70, first end 40 of container 14 includes a concave shape 150, Concave shape 150 of first end 40 of container 14 acts as a wiping means to empty substance 50 from container 14. For example, first end 40 of container 14 is deformed by actuation member 16 such that first end 40 includes a first deformed wall portion 152 and a second wall portion 154. Sidewall 24 of confinement structure 12 provides a stable wall surface which maintains second wall portion 154 in a configuration as shown in FIGS. 3-6B as actuation member 16 moves from the first position to the second position.

In this manner, first deformed wall portion 152 is deformed by actuation member 16 such that first deformed wall portion 152 folds up upon second wall portion 154 as shown in FIGS. 5A-6B. First deformed wall portion 152 is brought in direct contact with second wall portion 154 such that there is no space between first deformed wall portion 152 and second wall portion 154. In this manner, all of substance 50 is forced in a direction generally along arrow A (FIG. 5B) and away from concave shape 150 towards second end 42 of container 14. Furthermore, such controlled deformation of container 14 as described above ensures that no substance 50 is lost in the deformed corners of container 14. In this manner, with actuation member 16 in the second position (FIGS. 6A and 6B), substance 50 is completely, efficiently, and in a controlled manner expelled from container 14.

As discussed above, in one embodiment, exterior profile 66 of actuation member 16 is shaped to substantially correspond to interior profile 28 of confinement structure 12. In this manner, actuation member 16 and confinement structure 12 together allow for substance 50 to be completely expelled from container 14 with actuation member 16 in the second position as shown in FIG. 6B, i.e., substance 50 is expelled from container 14 such that no significant portion of substance 50 remains within container 14. Additionally, actuation member 16 and confinement structure 12 together provide a system that allows for controllable deformation of a container 14 such that a portion of the container 14 acts as a wiping means to empty a substance from the container 14.

In one embodiment, as discussed above, plunger sidewall 78 has a constant diameter between proximal wall 74 and distal wall 76 to control deformation of a container 14 such that a portion of the container 14 acts as a wiping means to empty a substance from the container 14 as described above. Referring to FIG. 6B, the constant diameter of plunger sidewall 78 between proximal wall 74 and distal wall 76 of plunger 70 ensures that first deformed wall portion 152 and second wall portion 154 of container 14 are maintained in concave shape 150 and disposed between sidewall 24 of confinement structure 12 and plunger sidewall 78. In this manner, with actuation member 16 in the second position (FIGS. 6A and 6B), substance 50 is completely, efficiently, and in a controlled manner expelled from container 14 such that a portion of the container 14 acts as a wiping means to empty a substance from the container 14. Additionally, referring to FIG. 6B, in this manner, actuation member 16 and confinement structure 12 provide a system that allows for controlled and consistent deformation of a container, i.e., each and every container is deformed in the same, controlled manner to completely expel a substance from the container.

As discussed above, sidewall 24 of confinement structure 12 provides a stable wall surface which maintains second wall portion 154 in a configuration as shown in FIGS. 3-6B as actuation member 16 moves from the first position to the second position. In this manner, first deformed wall portion 152 is deformed by actuation member 16 such that first deformed wall portion 152 folds up upon second wall portion 154 as shown in FIGS. 5A-6B. First deformed wall portion 152 is brought in direct contact with second wall portion 154 such that there is no space between first deformed wall portion 152 and second wall portion 154.

Figure 7:
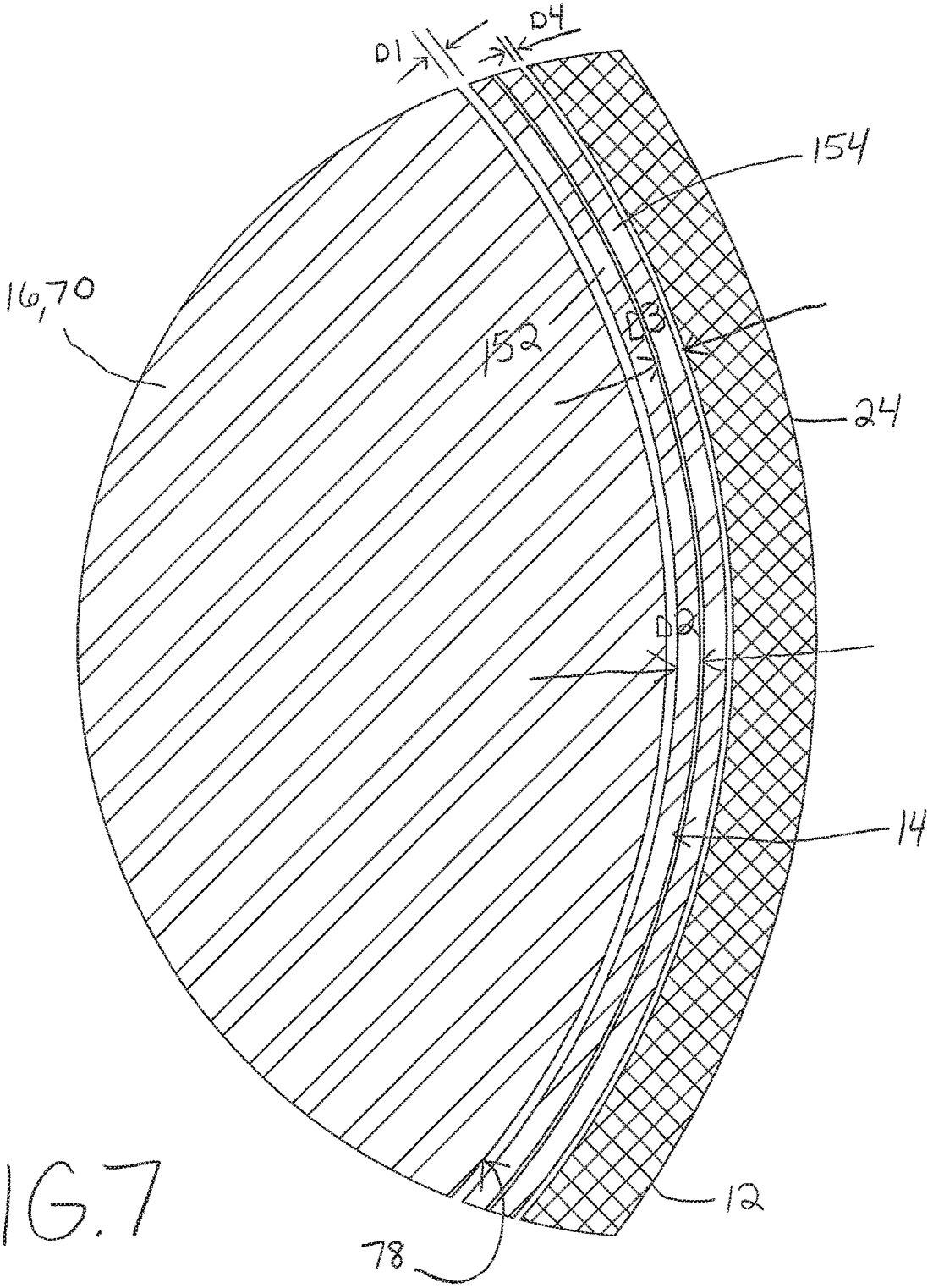
FIG. 7 is an enlarged, partial cross-sectional view taken along line 7-7 of FIG. 6A in accordance with an embodiment of the present invention.
Figure 8:
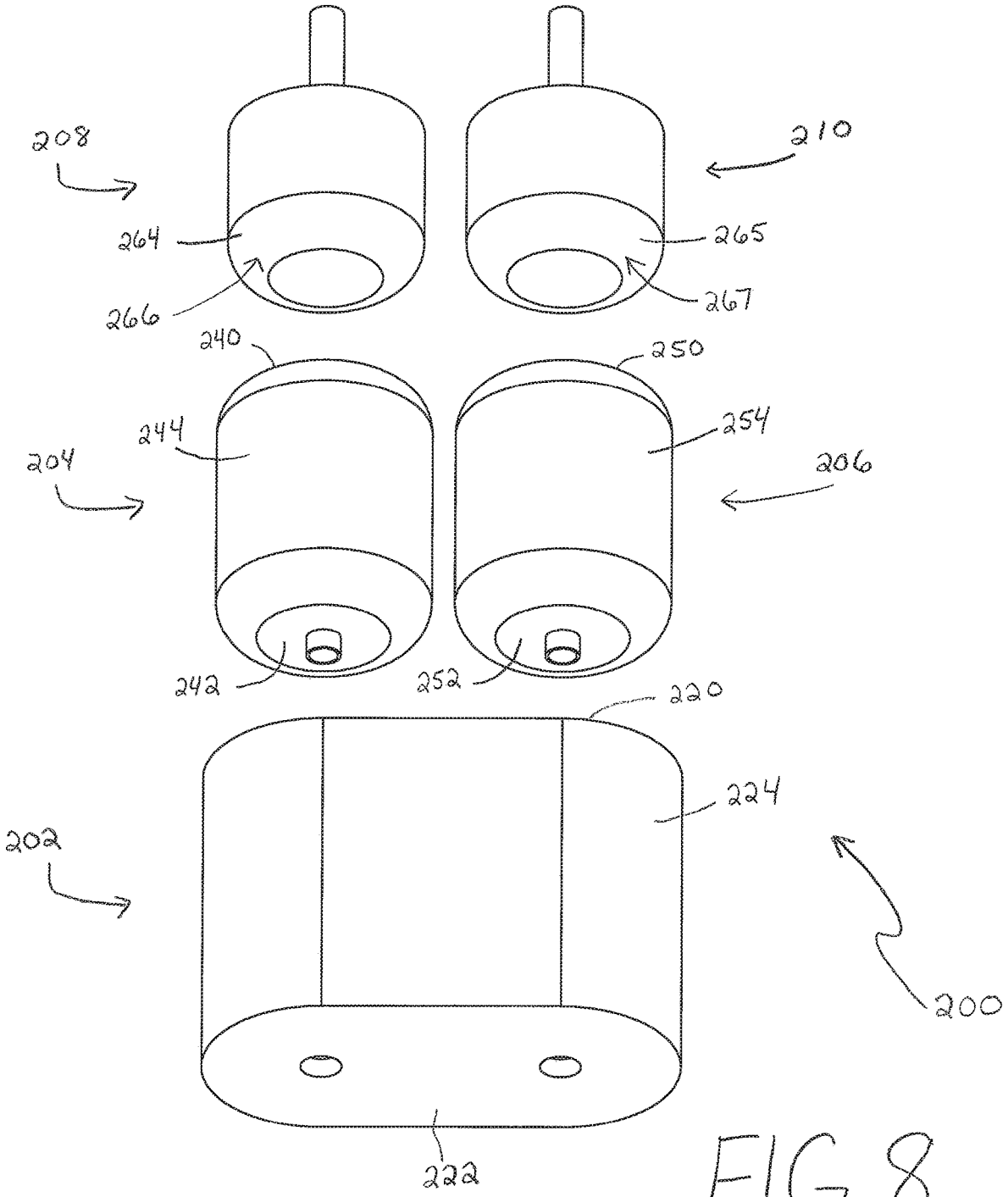
FIG. 8 is an exploded, perspective view of a substance dispensing system in accordance with another embodiment of the present invention.
Figure 9:
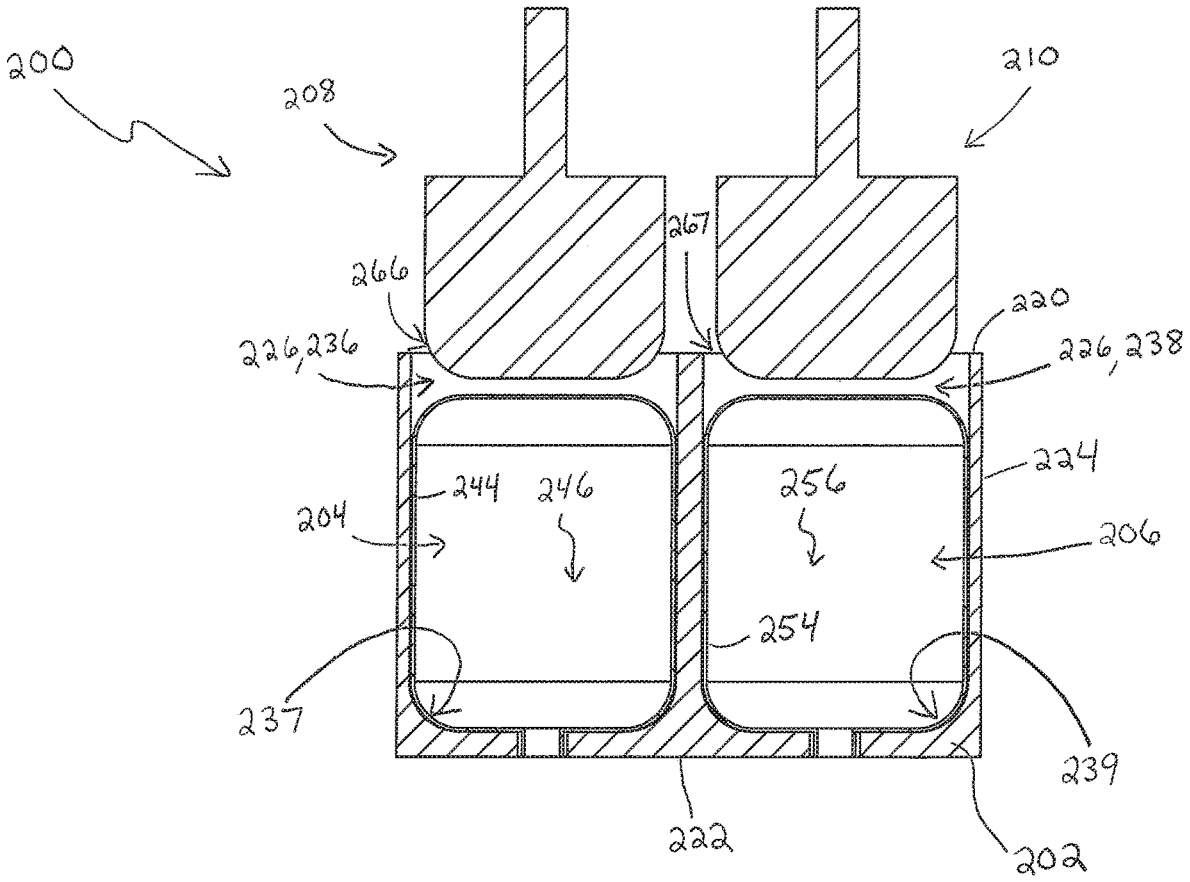
FIG. 9 is an assembled, cross-sectional view of the substance dispensing system of FIG. 8 with a first and second actuation member in a first position in accordance with an embodiment of the present invention.
Figure 10:
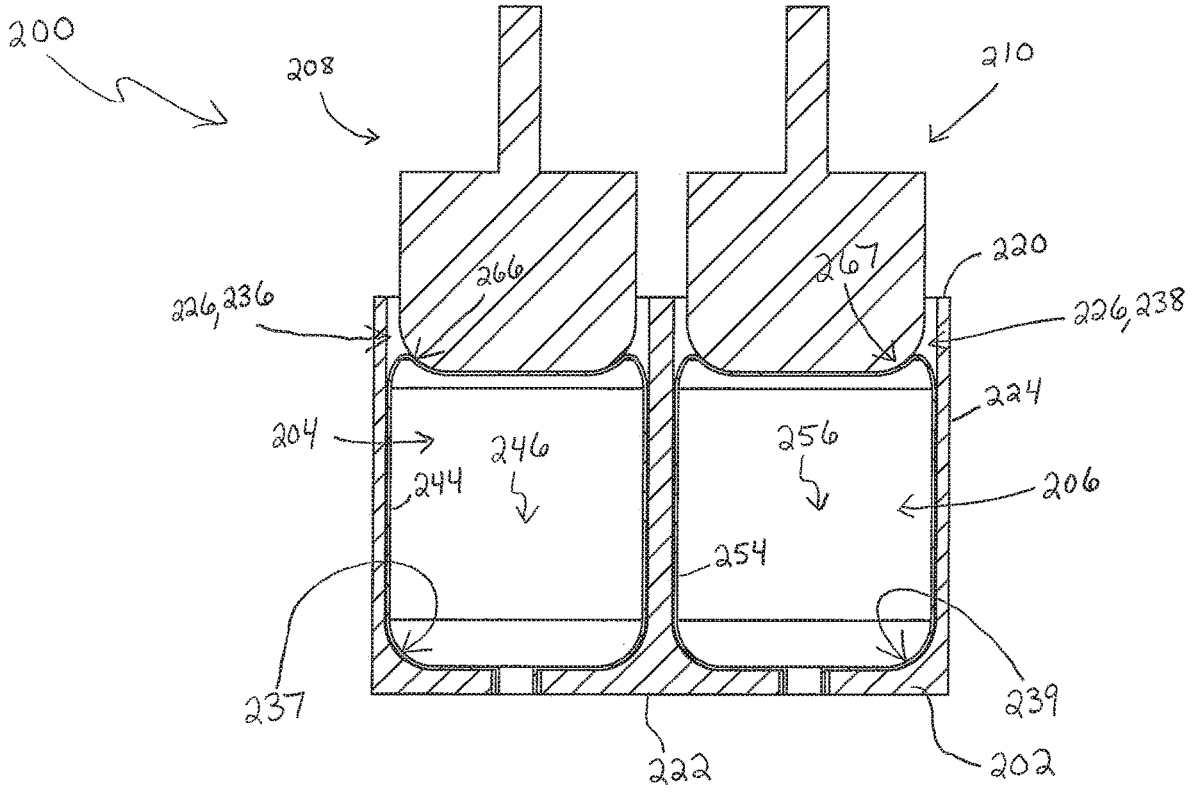
FIG. 10 is an assembled, cross-sectional view of the substance dispensing system of FIG. 8 with a first and second actuation member in a first intermediate position deforming a portion of a first and second container, respectively, in accordance with an embodiment of the present invention.
Figure 11:
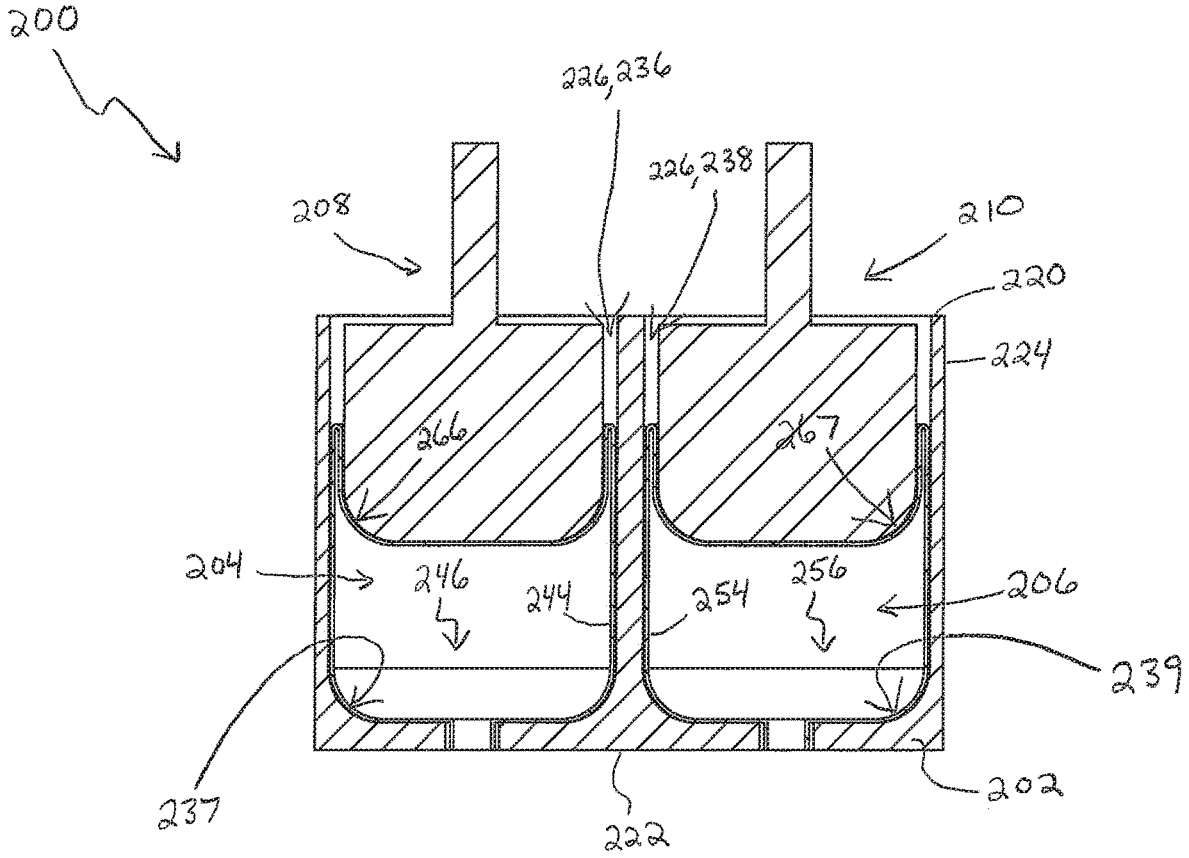
FIG. 11 is an assembled, cross-sectional view of the substance dispensing system of FIG. 8, with a first and second actuation member in a second intermediate position deforming a portion of a first and second container, respectively, in accordance with an embodiment of the present invention.

Referring to FIG. 7, in one embodiment, the interspace between actuation member 16 and confinement structure 12 will now be discussed. A first portion of this interspace is a distance between plunger sidewall 78 and first deformed wall portion 152 of container 14, e.g., distance D1. In some embodiments, distance D1 is approximately zero as the pressure of the substance 50 inside container 14 acts on first deformed wall portion 152 to resist the advancing force of actuation member 16. As actuation member 16 advances, first deformed wall portion 152 of container 14 continues to fold up upon second wall portion 154 as shown in FIGS. 5A-6B such that first deformed wall portion 152 is brought in direct contact with second wall portion 154 such that there is no space between first deformed wall portion 152 and second wall portion 154. In one embodiment, a second portion of the interspace between actuation member 16 and confinement structure 12 is the thickness of first deformed wall portion 152, e.g., distance D2. Another portion of the interspace between actuation member 16 and confinement structure 12 is the thickness of second wall portion 154, e.g., distance D3. In one embodiment, another portion of the interspace is a distance between second wall portion 154 and sidewall 24 of confinement structure 12, e.g., distance D4. In one embodiment, the sum of distances D1-D4 is approximately four (4) to seven (7) times the thickness of deformable wall 44 of container 14.

FIGS. 15A-19 illustrate an exemplary embodiment of the present disclosure. Referring to FIGS. 15A-19, a container 300 that is compatible with substance dispensing systems 10, 10A, 200, 200B of the present disclosure is shown. For example, actuation member 16 and confinement structure 12 are compatible with container 300 to provide a system that allows for controllable deformation of container 300.

Referring to FIGS. 15A-19, container 300 includes first end 302, second end 304, and a deformable wall 306 extending between first end 302 and second end 304. Deformable wall 306 of container 300 defines a container interior 308 adapted to hold a substance. Container 300 is adapted to hold a variety of different substances. For example, container 300 is adapted to hold various adhesives, coatings, and caulkings for a variety of different applications. Container 300 is sized and shaped to be positionable within an interior of confinement structure 12 or any similar confinement vessels. Container 300 has a tear resistance sufficient to withstand tearing during a controlled deformation process. In one embodiment, container 300 includes a first geometric portion, e.g., an indentation 310, formed in first end 302. Indentation 310 of container 300 defines indentation sidewall 320 and indentation bottom wall 322. Container 300 includes a container opening 312 located at second end 304 and container opening 312 is in fluid communication with container interior 308. In one embodiment, container opening 312 includes a second geometric portion, e.g., neck portion 314, which extends from second end 304 of container 300. Neck portion 314 defines an interior neck wall 328.

Figure 19:
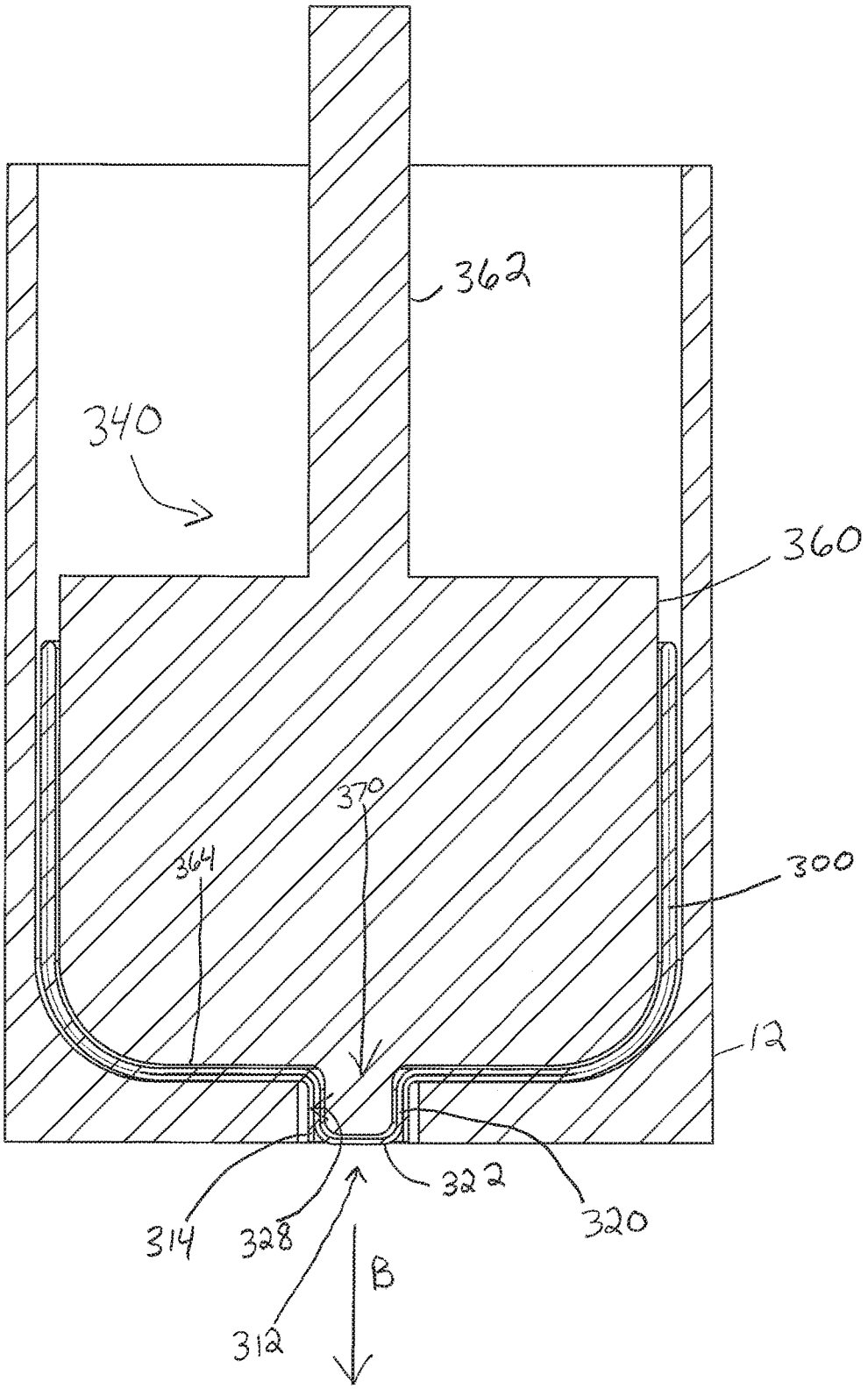
FIG. 19 is an assembled, cross-sectional view of the substance dispensing system of FIG. 15A, with an actuation member in a second position deforming a portion of a container in accordance with an embodiment of the present invention.
Figure 20A:
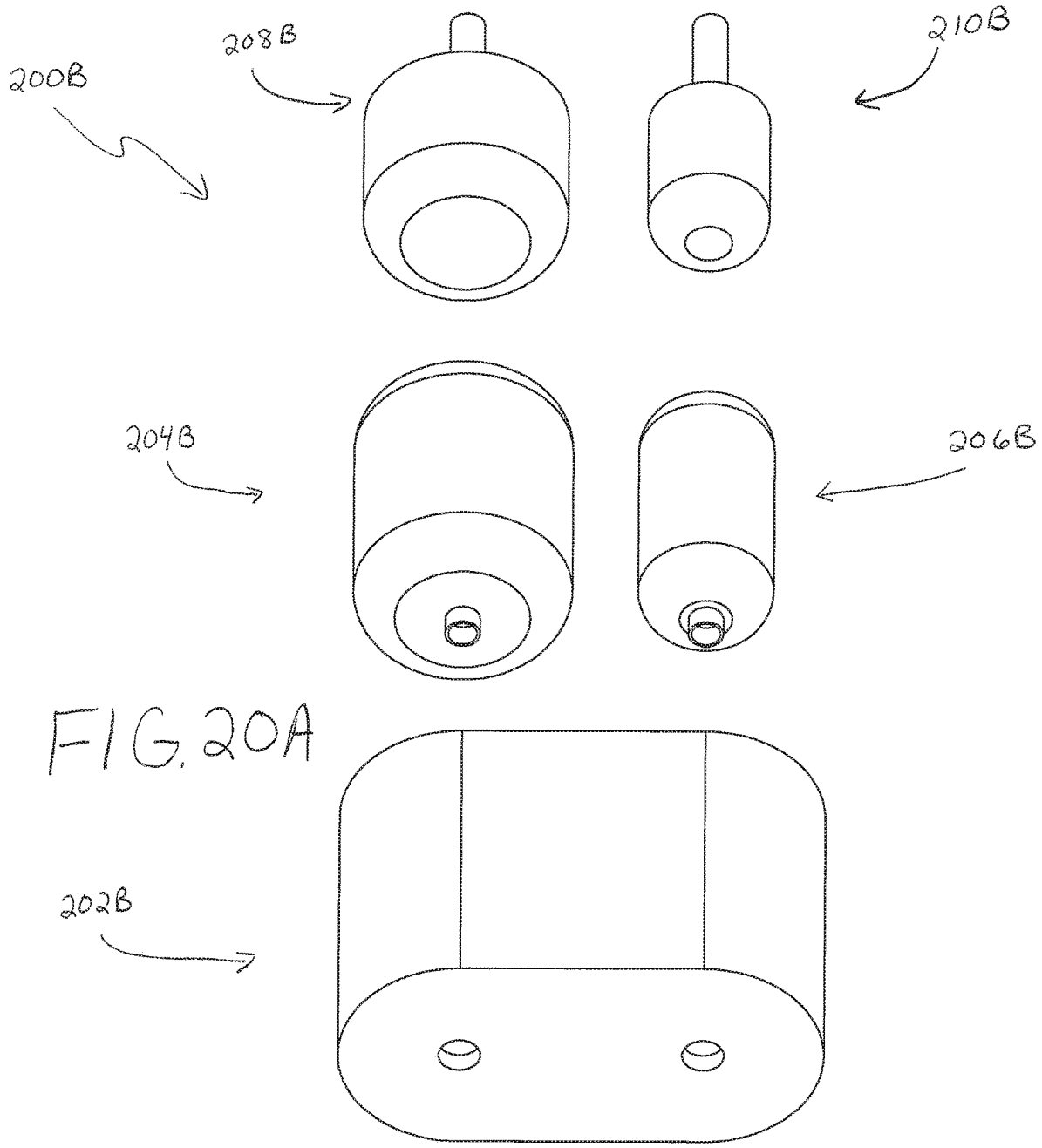
FIG. 20A is an exploded, perspective view of a substance dispensing system in accordance with another embodiment of the present invention.

Importantly, in an exemplary embodiment, when container 300 is deformed to a final position to expel a substance contained within container interior 308, the first geometric portion fits inside the second geometric portion as shown in FIG. 19. For example, in one embodiment, when container 300 is deformed to a final position to expel a substance contained within container interior 308, indentation 310 fits inside container opening 312 as shown in FIG. 19. In this manner, with indentation 310 inside container opening 312, a substance within container 300 is completely expelled from container 300. In one embodiment, with container 300 in the final position, indentation 310 of container 300 fits inside neck portion 314 of container 300 to completely expel a substance from container 300.

In this manner, with container 300 in the final position as shown in FIG. 19, indentation bottom wall 322 is disposed within neck portion 314 such that indentation sidewall 320 is brought in direct contact with interior neck wall 328 such that there is no space between indentation sidewall 320 and interior neck wall 328 as shown in FIG. 19. In this manner, all of a substance within container 300 is forced in a direction generally along arrow B (FIG. 19) and away from container opening 312 and out container 300. Furthermore, such controlled deformation of container 300 ensures that no substance is lost within container interior 308. In this manner, with container 300 in the final position as shown in FIG. 19, the substance is completely, efficiently, and in a controlled manner expelled from container 300.

Figure 15A:
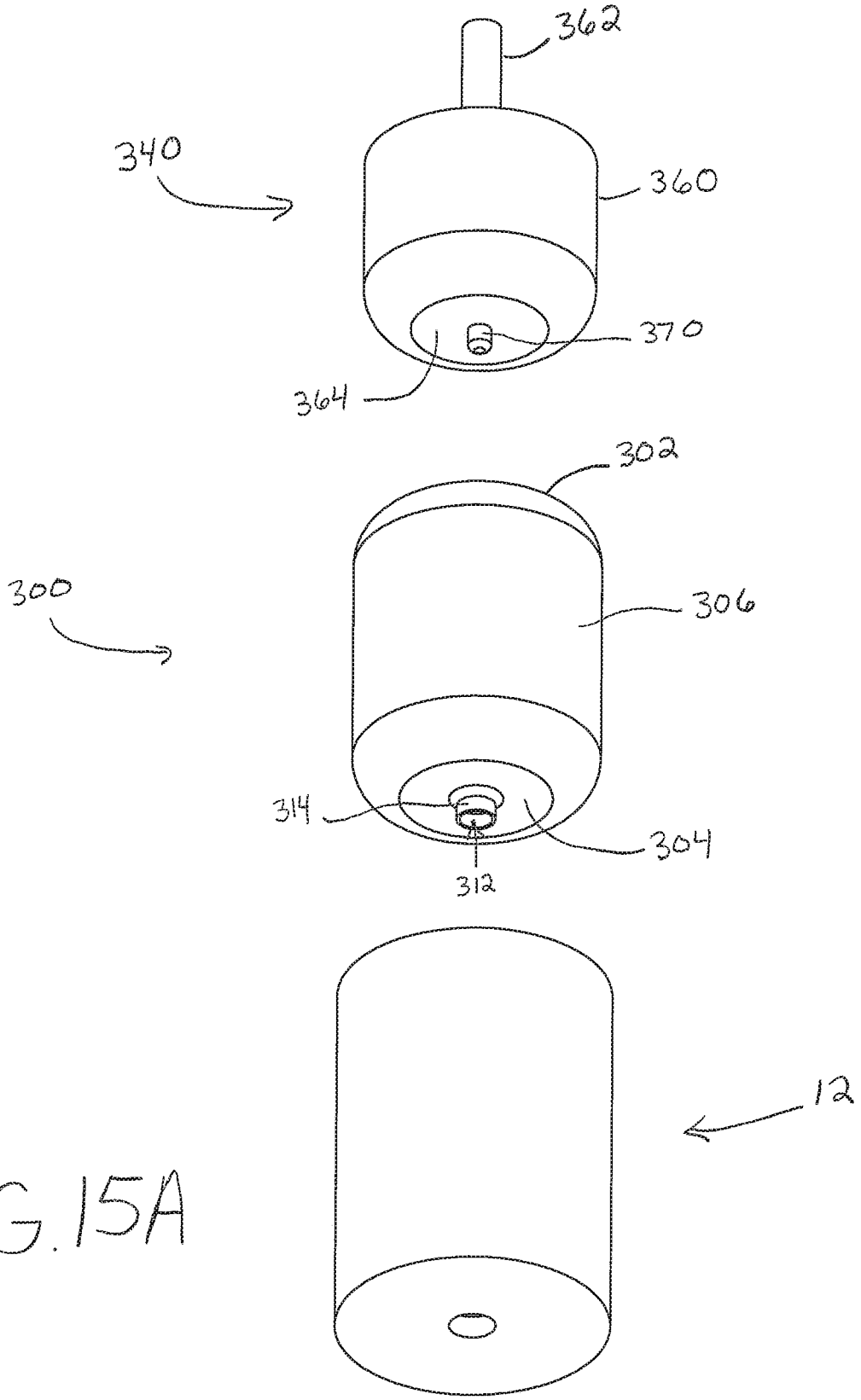
FIG. 15A is an exploded, perspective view of a substance dispensing system in accordance with another embodiment of the present invention.
Figure 15B:
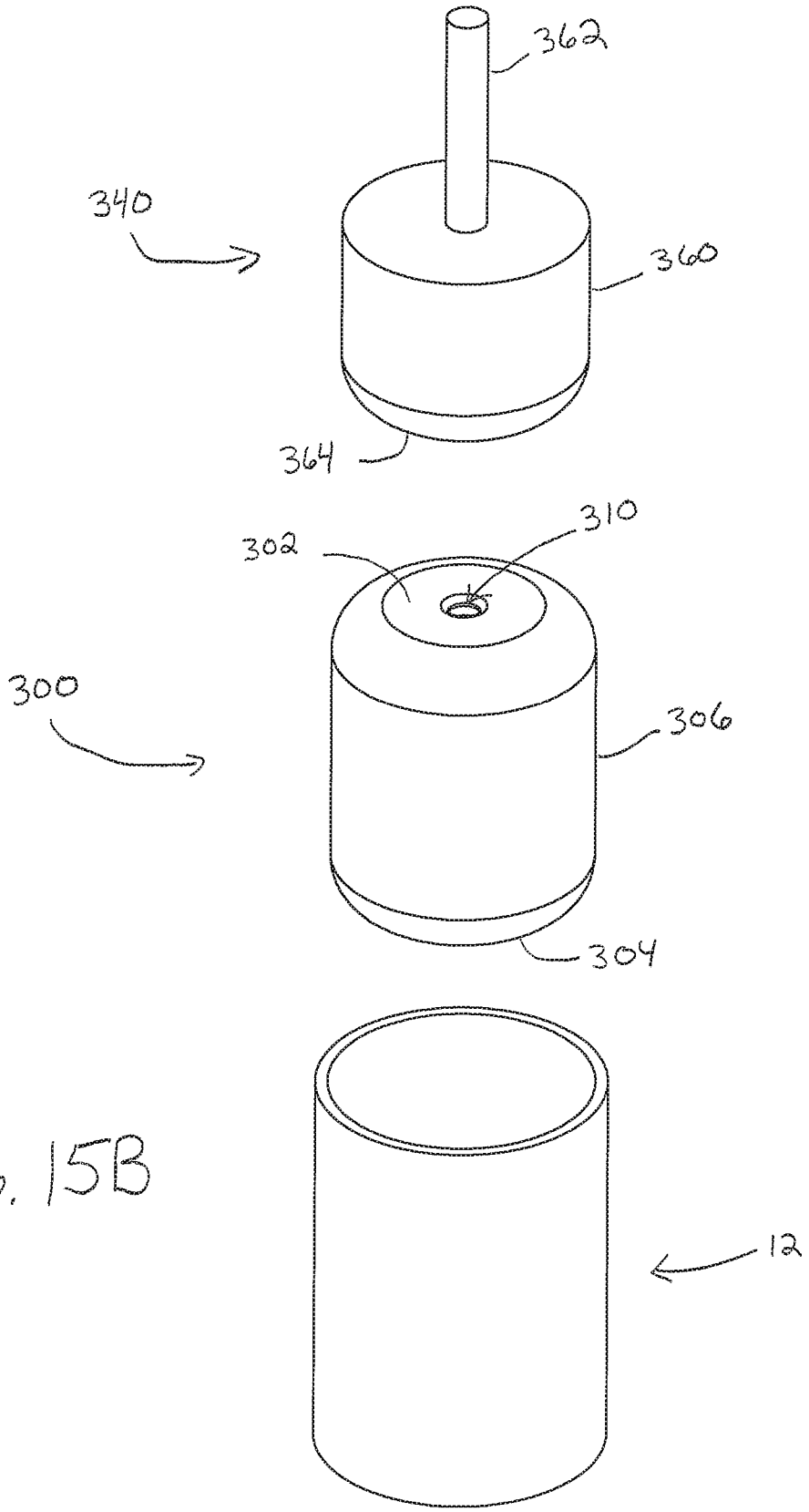
FIG. 15B is another exploded, perspective view of a substance dispensing system in accordance with another embodiment of the present invention.
Figure 16:
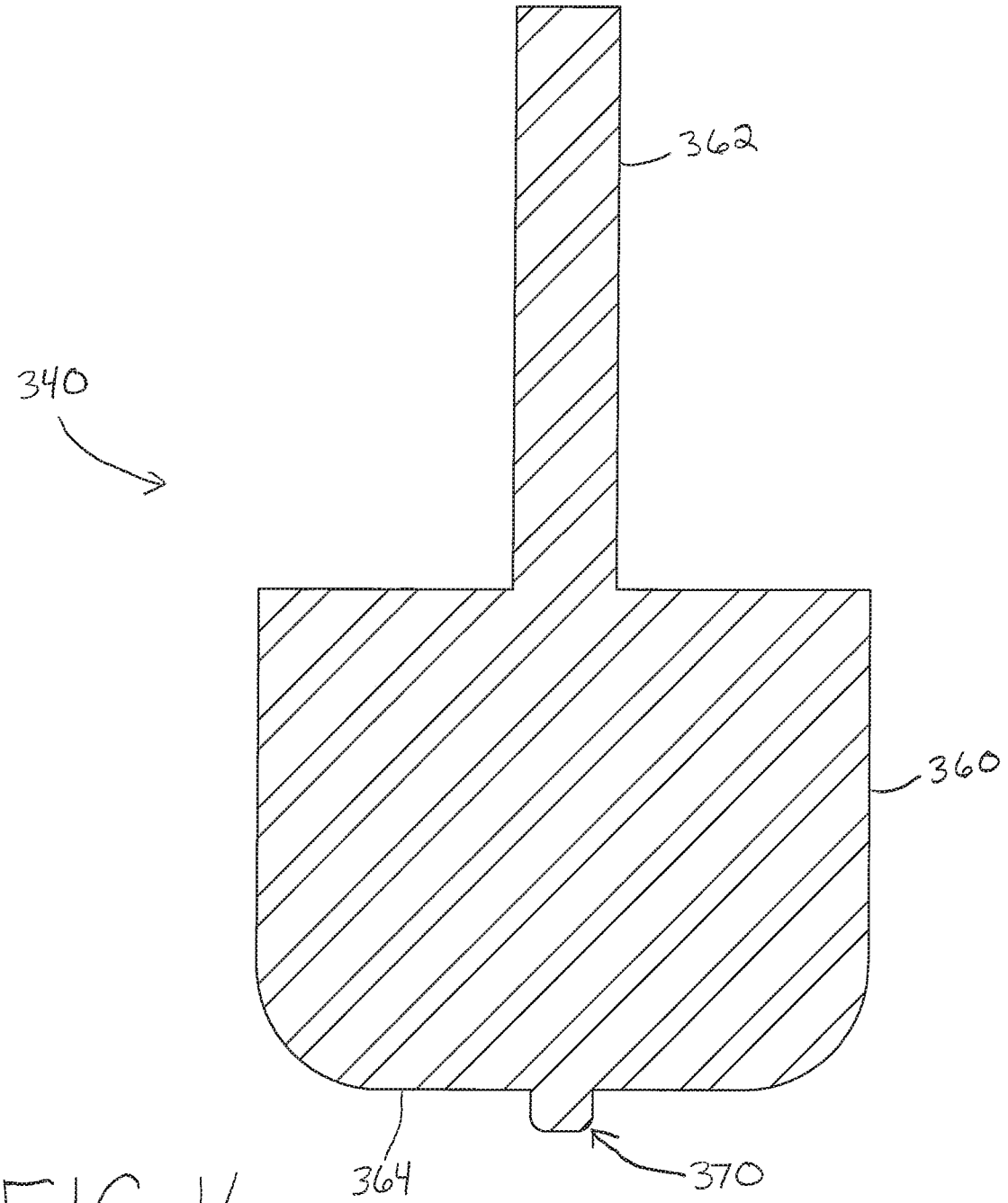
FIG. 16 is a cross-sectional view of an actuation member of FIG. 15A in accordance with another embodiment of the present invention.

Referring to FIGS. 15A-19, in one embodiment, actuation member 340 is compatible with container 300 of the present disclosure. Actuation member 340 includes head portion 360 having distal wall 364 and a shaft portion 362. Actuation member 340 may be slidably positionable within a confinement structure such as confinement structure 12. In one embodiment, head portion 360 include protruding member 370 extending from distal wall 364 as shown in FIGS. 15A and 16.

Figure 17:
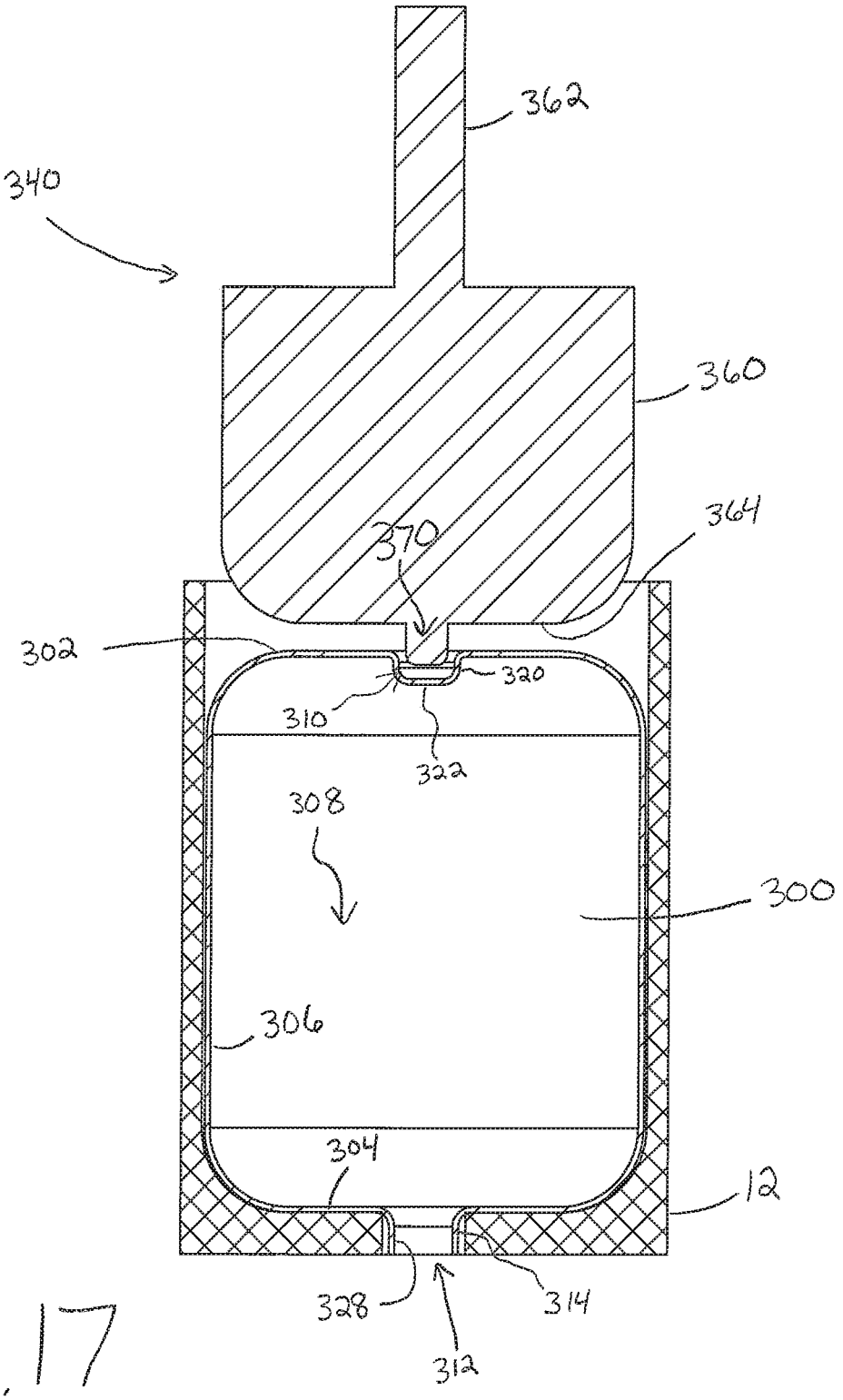
FIG. 17 is an assembled, cross-sectional view of the substance dispensing system of FIG. 15A with an actuation member in a first position in accordance with an embodiment of the present invention.
Figure 18:
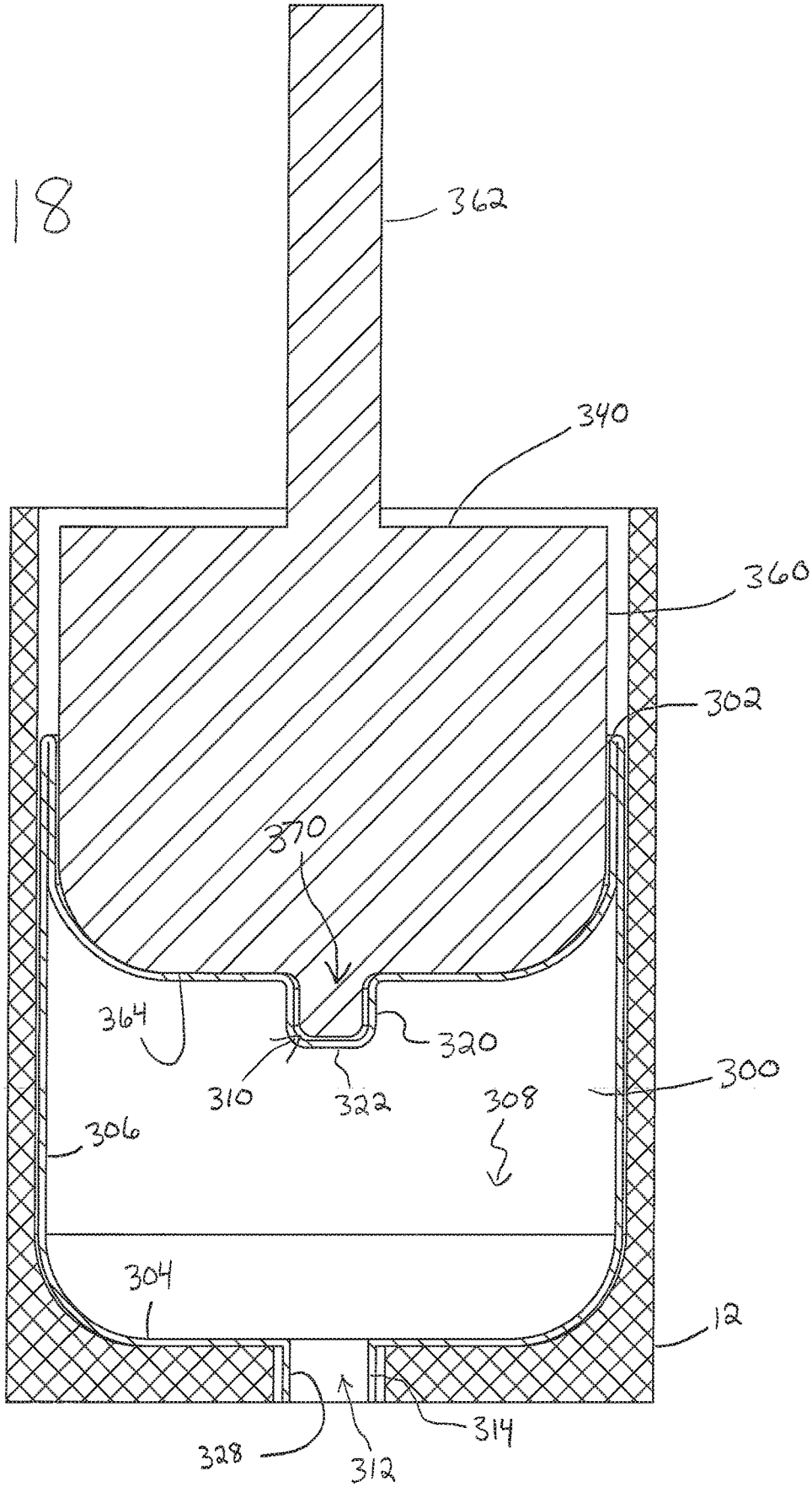
FIG. 18 is an assembled, cross-sectional view of the substance dispensing system of FIG. 15A with an actuation member in an intermediate position deforming a portion of a container in accordance with an embodiment of the present invention.

Head portion 360 is sized and shaped to contact first end 302 of container 300 to deform container 300 during a controlled deformation process as described above. For example, actuation member 340 is engaged with container 300 such that protruding member 370 of actuation member 340 is disposed within indentation 310 of container 300 as shown in FIGS. 17-19.

Shaft portion 362 of actuation member 340 is adapted to be placed in communication with a drive system for advancing actuation member 340 between a first position (FIG. 17) and a second position (FIG. 19), In this manner, as actuation member 340 moves from the first position towards the second position, actuation member 340 deforms container 300 thereby expelling a substance from container 300. In one embodiment, the drive system may be a hydraulic drive system including a hydraulic cylinder in communication with shaft portion 362 of actuation member 340. However, it is envisioned that other drive systems may be used. For example, the drive system could include other mechanical and electrical drive systems.

In one embodiment, actuation member 340 is compatible with confinement structure 12 to provide a substance disposing system 10 that allows for controllable deformation of a container 300 such that a portion of the container 300 acts as a wiping means to empty a substance from the container 300 as described above.

While this disclosure has been described as having exemplary designs, the present disclosure can be further modified within the spirit and scope of this disclosure. This application is therefore intended to cover any variations, uses, or adaptations of the disclosure using its general principles. Further, this application is intended to cover such departures from the present disclosure as come within known or customary practice in the art to which this disclosure pertains and which fall within the limits of the appended claims.

What is claimed is:

1. In combination:

a confinement structure having a proximal end, a distal end, and a sidewall extending therebetween and defining an interior, the distal end of the confinement structure defining an interior profile;

a self-supporting container having a first end, a second end, and a deformable wall connecting the first end to the second end and defining a container interior adapted to hold a substance, the self-supporting container comprising a first geometric portion formed in the first end and a container opening located at the second end, the container opening in fluid communication with the container interior, the container opening comprising a neck portion extending from the second end, the first geometric portion including a wall extending inward towards the second end of the container, the self-supporting container sized to be positionable within the interior of the confinement structure, the second end of the self-supporting container defining a container profile, and the self-supporting container having a rigid shape in an initial configuration, wherein the rigid shape comprises the first geometric portion; and an actuation member movably positionable within the confinement structure, the actuation member having an exterior wall defining an exterior profile, the exterior profile of the actuation member corresponds to the interior profile of the confinement structure, wherein, with the self-supporting container positioned outside the confinement structure and spaced from the actuation member, the rigid shape of the self-supporting container corresponds to the interior profile of the confinement structure, the self-supporting container having the rigid shape with no portion of the self-supporting container in contact with any portion of the confinement structure, wherein, with the self-supporting container positioned within the confinement structure, the actuation member is movable between a first position in which the actuation member is adjacent the proximal end of the confinement structure and a second position in which the actuation member is adjacent the distal end of the confinement structure, wherein as the actuation member moves from the first position towards the second position, the actuation member deforms the deformable wall of the self-supporting container thereby expelling the substance from the self-supporting container, and with the self-supporting container deformed to a final position, the first geometric portion fits inside the neck portion;

wherein the actuation member comprises a plunger, the plunger having a proximal wall, a distal wall, and a plunger sidewall extending therebetween, and as the plunger moves from the first position towards the second position, the plunger deforms the self-supporting container such that, a portion of the first end of the self-supporting container extends past the distal wall of the plunger towards the proximal wall of the plunger.

2. The combination of claim 1, wherein the actuation member has an actuation member diameter and the first end of the self-supporting container has a container diameter, the actuation member diameter less than the container diameter.

3. The combination of claim 2, wherein the proximal end of the confinement structure has an interior confinement structure diameter, the container diameter less than the interior confinement structure diameter.

4. The combination of claim 1, wherein the portion of the first end of the self-supporting container that extends past the distal wall of the plunger towards the proximal wall of the plunger is disposed between the sidewall of the confinement structure and the plunger sidewall.

5. The combination of claim 4, wherein with the portion of the first end of the self-supporting container extending past the distal wall of the plunger towards the proximal wall of the plunger, the first end of the self-supporting container comprises a concave shape.

6. The combination of claim 1, wherein with the plunger in the second position, the substance is completely expelled from the self-supporting container.

7. The combination of claim 1, wherein the exterior profile is defined by the distal wall of the plunger.

8. The combination of claim 1, wherein the proximal end of the confinement structure includes an open end and the distal end of the confinement structure includes an exit aperture, wherein as the plunger moves from the first position towards the second position, the plunger deforms the self-supporting container thereby expelling the substance from the self-supporting container and out the exit aperture of the confinement structure.

9. The combination of claim 1, wherein the self-supporting container has a tear resistance sufficient to withstand tearing when the plunger moves from the first position towards the second position.

10. The combination of claim 1, wherein the confinement structure is two components.

11. The combination of claim 1, wherein the confinement structure is three components.

12. The combination of claim 1, the substance is an adhesive.

13. The combination of claim 1, wherein the substance is a coating.

14. The combination of claim 1, wherein the substance is a caulking.

15. The combination of claim 1, wherein the container profile of the self-supporting container includes a first self-supporting container arcuate portion, a second self-supporting container arcuate portion, and a first self-supporting container planar portion between the first self-supporting container arcuate portion and the second self-supporting container arcuate portion, and wherein the interior profile of the confinement structure includes a first confinement structure arcuate portion, a second confinement structure arcuate portion, and a first confinement structure planar portion between the first confinement structure arcuate portion and the second confinement structure arcuate portion.

* * * * *